US006838234B2

(12) United States Patent
Seki

(10) Patent No.: US 6,838,234 B2
(45) Date of Patent: Jan. 4, 2005

(54) METHOD FOR PROCESSING SILVER HALIDE COLOR PHOTOGRAPHIC MATERIAL

(75) Inventor: Hiroyuki Seki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/096,895

(22) Filed: Mar. 14, 2002

(65) Prior Publication Data

US 2003/0068587 A1 Apr. 10, 2003

(30) Foreign Application Priority Data

Mar. 14, 2001 (JP) ..... P.2001-072431

(51) Int. Cl.[7] ..... G03C 7/30
(52) U.S. Cl. ..... 430/463
(58) Field of Search ..... 430/463

(56) References Cited

U.S. PATENT DOCUMENTS 5,104,775 A * 4/1992 Abe et al. ..... 430/372
5,359,080 A * 10/1994 Shimura et al. ..... 548/317

FOREIGN PATENT DOCUMENTS

| | | | |
|---|---|---|---|
| EP | 0 395 442 | * | 10/1990 |
| EP | 0467434 | * | 3/1992 |
| JP | 11-174646 A | | 7/1999 |
| JP | 295864 A | | 10/1999 |
| JP | 2000-98567 A | | 4/2000 |

* cited by examiner

*Primary Examiner*—Hoa Van Le
(74) *Attorney, Agent, or Firm*—Sughrue Mion, PLLC

(57) ABSTRACT

A method for processing a silver halide color photographic material comprising subjecting the color photographic material to processing which comprises the steps of color developing, fixing, rinsing and drying after the rinsing, wherein a rinsing solution used in the rinsing step comprises at least one compound represented by the following formula (I) and is a processing solution comprising none of an aldehyde compound, an aldehyde releasing compound and a hexamethylenetetramine derivative; and in the drying step, the drying temperature is 70° C. or more, and the drying time is 70 seconds or less:

$$R—(OC_2H_4)_n—OH \quad (I)$$

wherein R represents an alkyl group having from 8 to 12 carbon atoms, n is an integer of from 10 to 30, and n/(the carbon number of R) is from 1.2 to 4.0.

18 Claims, No Drawings

METHOD FOR PROCESSING SILVER HALIDE COLOR PHOTOGRAPHIC MATERIAL

FIELD OF THE INVENTION

The present invention relates to a method for processing a silver halide color photographic material, and more particularly to a method for processing a silver halide color photographic material, in which environmental safety is taken into consideration, and even rapid processing causes no physical defect in a processed photographic material.

BACKGROUND OF THE INVENTION

With a recent rise in social awareness of terrestrial environment protection, improvement in environmental safety has been demanded also in the field of photographic development processing. One of the measures taken for coping with this demand in the photographic industry is an effort to decrease photographic processing waste liquid to the lowest limit for reducing an environmental load, and the other is the removal of formalin used in a stabilizing stage or the safety management thereof for securing environmental safety. Techniques for attaining each purpose have been introduced.

In recent years, from the latter viewpoint, it has been pointed out that nonylphenoxypoly(ethylene oxy) compounds, surface active compounds for wetting used in stabilizing baths, also have a fear about safety of living environment in relation to substances disturbing physiological metabolic functions, in addition to formalin. It has been therefore desired that the amount thereof used is decreased, more preferably that a compound securing environmental safety and reducing surface tension is used in the place thereof. For example, JP-A-11-174646 (the term "JP-A" as used herein means an "unexamined published Japanese patent application") proposes the use of 4-halophenol derivatives.

On the other hand, as to the use of alternative compounds to formalin for reducing the amount of formalin used in rinsing solutions or removing formalin therefrom, for example, JP-A-11-295864 proposes the use of hexamethylenetetramine, and JP-A-2000-98567 proposes rinsing solutions or stabilizing solutions using hydroxybenzaldehyde or hexamethylenetetramine derivatives. However, the use of these alternative compounds in the rinsing or stabilizing solutions raises the problems of roller marks left on surfaces of photographic materials after processing, and increased functional defects such as curls, undulations on edges (local deformation) and processing stains.

Recently, for complying with speedy service to general users, particularly needs for the preparation of photographic prints from digital cameras, and rationalizing transport for collection and delivery between photo stores and photofinishing laboratories, storefront laboratories (mini-laboratories) have been popularized in which compact automatic processors are installed at the photo stores to process photographic materials. In the storefront laboratories, speedy service to customers is important, and particularly, there has been a growing demand for shortening the development processing time of silver salt photographs.

With the progress of rapid processing which is conducted using high-concentration processing solutions and/or at high temperatures, for shortening the development processing time, the degree of swelling increases. Drying of the resulting photographic materials at high temperatures for a short period of time causes increased functional defects such as curls, undulations on edges (local deformation), processing stains and roller marks, as described above. When the rapid processing involving drying at high temperatures for a short period of time and a reduction in the amount of formalin or the use of alternative rinsing solutions are both employed, these defects appear more remarkably. The solution thereof has therefore been desired more eagerly.

SUMMARY OF THE INVENTION

The present invention has been made against the background of the above, and an object thereof is to provide a method for processing a silver halide color photographic material, particularly to a processing method using a rinsing solution free from a substance having a fear about environmental safety in processing a silver halide color photographic material, and especially to a processing method in which a rinsing solution free from a substance having a fear about environmental safety is used and high-temperature rapid drying is possible.

More specifically, an object of the invention is to provide a method for processing a silver halide color photographic material, in which a rinsing solution contains none of formalin, a formalin-releasing compound, a hexamethylenetetramine derivative and a nonylphenoxy group-containing compound, and the photographic material can be processed without functional defects such as roller marks left on a surface of the photographic material, curls, undulations on edges (local deformation) and processing stains even on high-temperature rapid drying.

The present inventors have made intensive searches for compounds which can retain the film strength resistible to high-temperature rapid drying and compounds producing no processing stains even when light-sensitive layers of photographic materials are swelled, as additives for rinsing solutions. As a result, the present inventors have discovered that surface tension-reducing compounds having both these characteristics together are unexpectedly present. Further intensive studies have resulted in completion of the invention. The above-mentioned object of the invention is attained by the following (1) to (6):

(1) A method for processing a silver halide color photographic material comprising subjecting the color photographic material to processing containing a color developing stage, a fixing stage, a rinsing stage and a drying stage followed by the rinsing stage, wherein a rinsing solution used in the rinsing stage contains at least one compound represented by the following formula (I) and is a processing solution containing none of an aldehyde compound, an aldehyde releasing compound and a hexamethylenetetramine derivative; and in the drying stage, the drying temperature is 70° C. or more, and the drying time is 70 seconds or less:

$$R—(OC_2H_4)_n—OH \quad (I)$$

wherein R represents an alkyl group having from 8 to 12 carbon atoms, n is an integer of from 10 to 30, and n/(the carbon number of R) is from 1.2 to 4.0;

(2) The method described in the above (1), wherein the replenishment rate of the rinsing solution used in the rinsing stage is 850 ml/$m_2$ or less;

(3) The method described in the above (1) or (2), wherein the process time of the rinsing stage is 75 seconds or less;

(4) The method described in any one of the above (1) to (3), wherein the process time of the fixing stage is 90 seconds or less;

(5) The method described in any one of the above (1) to (4), wherein an overflow from a rinsing solution tank partly flows in a fixing tank; and (6) The method described in any one of the above (1) to (5), wherein the rinsing solution contains dichloroisocyanuric acid in an amount of 0.005 g/liter to 0.1 g/liter.

The compound of formula (I) is classified as a polyethylene glycol alkyl ether, and a compound having a oxyethylene chain length within the specific range and an alkyl group having carbon atoms within the specific range. From another viewpoint, it is said to be a compound in which a hydrophilic moiety and a hydrophobic moiety are balanced with each other in molecular weight and chain length within the specific ranges. It has been discovered that the polyethylene glycol alkyl ether within the range defined by formula (I) causes roller marks left on surfaces of photographic materials, fixing of curls, local deformation of edges of photographic materials and stains of image layers on a level similar to one in the case of current standard processing, even when the photographic materials are processed in a rinsing stage free from formalin and hexamethylenetetramine, followed by rapid drying. In contrast, a polyethylene glycol alkyl ether outside the range defined by formula (I) deteriorates roller marks left on surfaces of photographic materials, curls, local deformation of edges and image stains. A mechanism is unknown by which the compound (surfactant) within the range defined by formula (I) exhibits such an effect. However, it is considered that changes in solution characteristics such as surface tension associated with surfactant alterations, changes in the degree of swelling of the surfaces of the photographic materials associated with the removal of components such as formalin and changes in the rate of drying associated with alterations in drying conditions are related thereto as complex factors.

Accordingly, the color photographic material-processing method of the invention is particularly suitable for rapid processing involving high-temperature rapid drying, and particularly favorably applicable to storefront laboratories in which it is difficult to control work and equipment with respect to the environmental safety of compounds, and speedy service to customers is required.

DETAILED DESCRIPTION OF THE INVENTION

Details of the invention will be described below.

The rinsing solution as used in the invention means a processing solution used in a rinsing bath in a rinsing stage. The rinsing stage is an image-stabilizing stage serving as a washing stage, too, that is to say, a stage in which processing is carried out in an alternative stabilizing bath to washing. Accordingly, the rinsing solution is substantially the same as a processing solution which has hitherto been called a stabilizing solution, with the exception that after the processing, further washing is not necessarily required. In this sense, the scope of application of the processing method of the invention relating to the rinsing solution is understood to extend to the processing solution called the stabilizing solution.

The composition of the rinsing solution used in the invention will be described below. First, the compound of formula (I) will be described. In formula (I), R is an alkyl group having from 8 to 12 carbon atoms, and may be either straight-chain or branched. Further, although n is from 10 to 30, n is preferably a number of 1.2 to 4.0 times the carbon number of R, and more preferably a number of 1.5 to 3.5 times the carbon number of R. The compounds represented by formula (I) include the following:

Compounds of Formula (I)

$(n)C_8H_{17}—(OC_2H_4)_{10}—OH$ (I-1)

$(n)C_8H_{17}—(OC_2H_4)_{15}—OH$ )I-2)

$(n)C_8H_{17}—(OC_2H_4)_{20}—OH$ (I-3)

$(n)C_8H_{17}—(OC_2H_4)_{25}—OH$ (I-4)

$(n)C_8H_{17}—(OC_2H_4)_{30}—OH$ (I-5)

$(n)C_9H_{19}—(OC_2H_4)_{12}—OH$ (I-6)

$(n)C_9H_{19}—(OC_2H_4)_{15}—OH$ (I-7)

$(n)C_9H_{19}—(OC_2H_4)_{20}—OH$ (I-8)

$(n)C_9H_{19}—(OC_2H_4)_{25}—OH$ (I-9)

$(n)C_9H_{19}—(OC_2H_4)_{30}—OH$ (I-10)

$(n)C_9H_{19}—(OC_2H_4)_{35}—OH$ (I-11)

$(n)C_{10}H_{21}—(OC_2H_4)_{15}—OH$ (I-12)

$(n)C_{10}H_{21}—(OC_2H_4)_{20}—OH$ (I-13)

$(n)C_{10}H_{21}—(OC_2H_4)_{25}—OH$ (I-14)

$(n)C_{10}H_{21}—(OC_2H_4)_{30}—OH$ (I-15)

$C_{12}H_{25}—(OC_2H_4)_{20}—OH$ (I-16)

$C_{12}H_{25}—(OC_2H_4)_{30}—OH$ (I-17)

$CH_3(CH_2)_3CH(C_2H_5)CH_2—(OC_2H_4)_{15}—OH$ (I-18)

$CH_3(CH_2)_3CH(C_2H_5)CH_2—(OC_2H_4)_{20}—OH$ (I-19)

$CH_3(CH_2)_3CH(C_2H_5)CH_2—(OC_2H_4)_{25}—OH$ (I-20)

$CH_3(CH_2)_3CH(C_2H_5)CH_2—(OC_2H_4)_{30}—OH$ (I-21)

$CH_3(CH_2)_3CH(C_3H_7)CH_2—(OC_2H_4)_{30}—OH$ (I-22)

$CH_3(CH_2)_3CH(C_2H_5)CH_2—(OC_2H_4)_{30}—OH$ (I-23)

$CH_3(CH_2)_6CH(CH_3)—(OC_2H_4)_{30}—OH$ (I-24)

$CH_3(CH_2)_3CH(CH_3)_2CH_2—(OC_2H_4)_{30}—OH$ (I-25)

$CH_3(CH_2)_3CH(CH_3)CH_2—(OC_2H_4)_{25}—OH$ (I-26)

$CH_3(CH_2)_6CH(CH_3)—(OC_2H_4)_{25}—OH$ (I-27)

Of the above-mentioned compounds, preferred are compounds (I-1), (I-6), (I-12) and (I-16), and particularly preferred are compounds (I-1), (I-6) and (I-12), each of which has from 8 to 10 carbon atoms.

The concentration of the compound of formula (I) contained in the rinsing solution ranges from 0.05 g/liter to 5.0 g/liter, preferably from 0.1 g/liter to 1.0 g/liter, and more preferably from 0.2 g/liter to 0.5 g/liter.

The pH of the rinsing solution is preferably from 3 to 10, and more preferably from 5 to 8. The temperature is generally from 20° C. to 50° C., preferably from 25° C. to 45° C., more preferably from 41° C. to 45° C., although it can be variously established depending on the use of the photographic material and the characteristics thereof.

A method for reducing calcium and magnesium described in JP-A-62-288838 is extremely effectively applicable to the rinsing solution. Further, there can also be used isothiazolone compounds and thiabendazoles described in JP-A-57-8542, chlorine disinfectants such as chlorinated sodium isocyanurate described in JP-A-61-120145, benzotriazole and copper ions described in JP-A-61-267761, and further, the disinfectants described in Hiroshi Horiguchi, "Bohkin Bohbaizai no Kagaku" (Chemistry of Disinfectants and Fungicides), Sankyo Shuppan (1986), "Biseibutsu no Mekkin, Sakkin, Bohbai Gijutsu" (Sterilization, Pasteurization and Fungus Prevention Techniques of Microorganisms), edited by Eisei Gijutsukai, Kogyo Gijutsukai (1982) and "Bokin Bohbaizai Jiten" (Dictionary of Disinfectants and Fungicides) edited by Nippon Bohkin Bohbai Gakkai (1986).

In addition to the compound of formula (I), surfactants other than the compound of formula (I) can be used as wetting agents, and chelating agents represented by EDTA and ethylenediaminesuccinic acid can also be used as water softeners.

Although the composition of the rinsing solution used in the invention has been described above, further descriptions of the rinsing solution including the replenishment rate of the rinsing solution will be described later in the items of the processing stages of the invention and processing apparatus to which the invention is applied.

Respective processing solutions other than the above-mentioned rinsing solution which are used in the color development processing method of the invention will be described.

A color developing solution contains a color developing agent. Preferred examples thereof are known aromatic primary amine color developing agents, particularly p-phenylenediamine derivatives, and typical examples thereof include but are not limited to the following compounds:

1) N,N-diethyl-p-phenylenediamine
2) 4-Amino-3-methyl-N,N-diethylaniline
3) 4-Amino-N-(β-hydroxyethyl)-N-methylaniline
4) 4-Amino-N-ethyl-N-(β-hydroxyethyl)aniline
5) 4-Amino-3-methyl-N-ethyl-N-(β-hydroxyethyl)aniline
6) 4-Amino-3-methyl-N-ethyl-N-(3-hydroxypropyl)-aniline
7) 4-Amino-3-methyl-N-ethyl-N-(4-hydroxybutyl)aniline
8) 4-Amino-3-methyl-N-ethyl-N-(β-methanesulfonamido-ethyl)aniline
9) 4-Amino-N,N-diethyl-3-(β-hydroxyethyl)aniline
10) 4-Amino-3-methyl-N-ethyl-N-(β-methoxyethyl)-aniline
11) 4-Amino-3-methyl-N-(β-ethoxyethyl)-N-ethylaniline
12) 4-Amino-3-methyl-N-(3-carbamoylpropyl)-N-n-propyl aniline
13) 4-Amino-N-(4-carbamoylbutyl)-N-n-propyl-3-methylaniline
14) N-(4-Amino-3-methylphenyl)-3-hydroxypyrrolidine
15) N-(4-Amino-3-methylphenyl)-3-(hydroxymethyl)-pyrrolidine
16) N-(4-Amino-3-methylphenyl)-3-pyrrolidine-carboxamide Of the above-mentioned p-phenylenediamine derivatives, particularly preferred are compounds 5), 6), 7), 8) and 12), and of these, preferred are compounds 5) and 8). These p-phenylenediamine derivatives are usually in the form of salts such as sulfates, hydrochlorides, sulfites, naphthalene-disulfonate and p-toluenesulfonates, in the state of solid materials.

The aromatic primary amine developing agent is added to the processing solution so that the concentration of the developing agent in the solution used is from 2 mmol to 200 mmol, preferably from 6 mmol to 100 mmol, and more preferably from 10 mmol to 40 mmol, per liter of developing solution.

The color developing solution either contains sulfite ions in small amounts or is substantially free from sulfite ions in some cases, depending on the kind of subject photographic material. However, in the invention, it is preferred that the color developing solution contains sulfite ions in small amounts. The sulfite ions have significant preservative action, whereas in some cases, an excess thereof exerts an undesirable effect on photographic properties in the course of color development.

Further, the color developing solution may contain a small amount of hydroxylamine. Hydroxylamine (although it is generally used in the form of the hydrochloride or the sulfate, the salt form is hereinafter omitted) contained in the developing solution acts as a preservative for the developing solution similarly to the sulfite ions, and also concurrently has an effect on photographic properties in some cases, because of silver development activity of hydroxylamine itself. It is therefore necessary to add hydroxylamine in reduced amounts.

In addition to the above-mentioned hydroxylamine and sulfite ions, organic preservatives may be added to the color developing solutions. The organic preservatives mean the whole organic compounds which reduce the rate of deterioration of the aromatic primary amine color developing agents by adding them to the processing solutions for the photographic materials. That is to say, they are organic compounds having the function of preventing the air oxidation of the color developing agents. Above all, particularly effective organic preservatives are hydroxamic acids, hydrazines, phenols, α-hydroxyketones, α-aminoketones, saccharides, monoamines, diamines, polyamines, quaternary ammonium salts, nitroxyl radicals, alcohols, oximes, diamide compounds and cyclocondensed amines, including the above-mentioned hydroxylamine derivatives. These are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020 and JP-B-48-30496 (the term "JP-B" as used herein means an "examined Japanese patent publication").

As other preservatives, various metals described in JP-A-57-44148 and JP-A-57-53749, salicylic acid derivatives described in JP-A-59-180588, alkanolamines described in JP-A-54-3532, polyethyleneimines described in JP-A-56-94349 and aromatic polyhydroxy compounds described in U.S. Pat. No. 3,746,544 may be contained as needed. In particular, for example, alkanolamines such as triethanolamine and tri-isoprpanolamine, substituted or unsubstituted dialkyl-hydroxylamines such as disulfoethylhydroxylamine and diethyl-hydroxylamine, or aromatic polyhydroxy compounds may be added.

Of the above-mentioned organic preservatives, details of the hydroxylamine derivatives are described in JP-A-1-97953, JP-A-1-186939, JP-A-1-186940and JP-A-1-1-187557. Especially, it can also be effective in terms of improvement in stability of the color developing solutions and improvement in stability in continuous processing to add both the hydroxylamine derivatives and the amines.

The above-mentioned amines include cyclic amines as described in JP-A-63-239447, amines as described in JP-A-

63-128340, and other amines as described in JP-A-1-186939 and JP-A-1-187557. Although the content of the preservative in the processing solution varies depending on the kind of preservative, the preservative is generally added to the solution used so as to give a concentration of 1 mmol to 200 mmol, preferably 10 mmol to 100 mmol, per liter of developing solution.

Chlorine ions may be added to the color developing solutions, for example, developing solutions for color paper, as needed. The color developing solutions (particularly, developing agents for color print materials) usually contain the chlorine ions in an amount of $3.5\times10^{-2}$ mol/liter to $1.5\times10^{-1}$ mol/liter in many cases. However, the chlorine ions are usually released in the developing solutions as by-products of development, so that it is unnecessary to add the chlorine ions to developing solutions for replenishment, in many cases. Developing agents for photographic materials for shooting may contain no chlorine ions.

As to bromine ions, it is preferred that they are contained in the color developing solutions in an amount of about $1\times10^{-3}$ mol/liter to $5\times10^{-3}$ mol/liter in processing of the materials for shooting, and in an amount of $1.0\times10^{-3}$ mol/liter or less in processing of the print materials. However, the color developing agents do not require the bromine ions in many cases, similarly to the above-mentioned chlorine ions. When added, the bromine ions can also be added to the processing agents so as to give a bromine ion concentration within the above-mentioned range, as needed.

When the subject photographic materials are ones obtained from silver iodobromide emulsions, such as color negative films and color reversal films, the situation in respect to iodine ions is also the same. However, the iodine ions are usually released from the photographic materials to yield an iodine ion concentration of about 0.5 mg to about 10 mg per liter of developing solution, so that they normally are not contained in the processing agents for replenishment.

When halides are used as additives to the developing solutions and the development replenishers, chlorine ion-feeding materials include sodium chloride, potassium chloride, ammonium chloride, lithium chloride, nickel chloride, magnesium chloride, manganese chloride and calcium chloride. Of these, preferably used are sodium chloride and potassium chloride.

Bromine ion-feeding materials include sodium bromide, potassium bromide, ammonium bromide, lithium bromide, calcium bromide, magnesium bromide, manganese bromide, nickel bromide, cerium bromide and thallium bromide. Of these, preferably used are sodium bromide and potassium bromide.

As iodine ion-feeding materials, there are used sodium iodide and potassium iodide.

In the invention, the pH of the developing solutions is preferably from 9.0 to 13.5, and the pH of the replenishers is preferably from 9.0 to 13.5. Accordingly, alkali agents, buffers and optionally acid agents can be added to the developing solutions and the replenishers so that their pH values can be maintained.

For maintaining the above-mentioned pH at the time when the processing solutions are prepared, various buffers are preferably used. As the buffers, there can be used carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propane-diol salts, proline salts, trishydroxyaminomethane salts and lysine salts. In particular, carbonates, phosphates, tetraborates and hydroxybenzoates have the advantages that they are excellent in buffering ability in the high pH region of 9.0 or more, that they have no adverse effect (such as fogging) on photographic properties even when added to the color developing solutions, and that they are low in cost. The use of these buffers is particularly preferred.

Examples of these buffers include but are not limited to sodium carbonate, potassium carbonate, sodium bicarbonate, potassium bicarbonate, trisodium phosphate, tripotassium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate).

The buffers are not components consumed by reaction, so that the amount thereof added to compositions is determined so as to give a concentration of 0.01 mol to 2 mol per liter, preferably a concentration of 0.1 mol to 0.5 mol per liter, for both the developing solutions and replenishers prepared from processing agents.

Various chelating agents which are suspending agents for other color developing solution components, for example, calcium and magnesium, or which are stability improvers for the color developing solutions can also be added to the color developing solutions. Examples thereof include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycoletherdiaminetetraacetic acid, ethylenediamine-o-hydroxyphenylacetic acid, ethylenediaminedisuccinic acid (SS form), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl) ethylenediamine-N,N'-diacetic acid and 1,2-dihydroxybenzene-4,6-disulfonic acid.

These chelating agents may be used as a combination of two or more of them as needed.

The amount of these chelating agents may be any, as long as it is sufficient to block metal ions contained in the color developing solutions prepared. For example, they are added in an amount of about 0.1 g to about 10 g per liter.

Any development accelerators can be added to the color developing solutions as needed. The development accelerators which can be added as needed include thioether compounds described in JP-B-37-16088, JP-B-37-5987, JP-B-38-7826, JP-B-44-12380, JP-B-45-9019 and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826 and JP-A-52-43429; amine compounds described in U.S. Pat. Nos. 2,494,903, 3,128,182, 4,230,796 and 3,253,919, JP-B-41-11431 2, U.S. Pat. Nos. 2,482,546, 2,596,926 and 3,582,346; polyalkylene oxides described in JP-B-37-16088, JP-B-42-25201, U.S. Pat. No. 3,128,183, JP-B-41-11431, JP-B-42-23883 and U.S. Pat. No. 3,532,501; and 1-phenyl-3-pyrazolidone compounds or imidazole compounds. The amount thereof added to compositions is determined so as to give a concentration of 0.001 mol to 0.2 mol per liter, preferably a concentration of 0.01 mol to 0.05 mol per liter, for both the developing solutions and replenishers prepared from processing agents.

In addition to the above-mentioned halogen ions, any antifoggants can be added to the color developing solutions used in the invention, as needed. Typical examples of organic antifoggants include, for example, nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

Further, various surfactants such as alkylsulfonic acids, arylsulfonic acids, aliphatic carboxylic acids and aromatic carboxylic acids may be added to the color developing solutions as needed. The amount thereof added to compositions is determined so as to give a concentration of 0.0001 mol to 0.2 mol per liter, preferably a concentration of 0.001 mol to 0.05 mol per liter, for both the developing solutions and replenishers prepared from processing agents.

In the invention, fluorescent brightening agents can be used as needed. As the fluorescent brightening agents, bis(triazinylamino)stilbenesulfonic acid compounds are preferred. As the bis(triazinylamino)stilbenesulfonic acid compounds, known or commercial diaminostilbene brightening agents can be used. As the known bis(triazinylamino) stilbenesulfonic acid compounds, for example, compounds described in JP-A-6-329936, JP-A-7-140625 and JP-A-10-140849 are preferred. The commercial compounds are described, for example, in "Senshoku Note" (Dying Note), the ninth edition (Shokusensha), pages 165 to 168, and of the compounds described therein, preferred are Blankophor BSU liq. and Hakkol BRK.

Then, processing solutions used in the course of desilverization will be described. First, bleaching agents for bleaching solutions and for bleaching-fixing solutions in color development processing will be described.

As the bleaching agents used in the bleaching solutions or the bleaching-fixing solutions, known bleaching agents can be used. However, organic complex salts of iron (III) (for example, complex salts of aminopolycarboxylic acids), organic acids such as citric acid, tartaric acid and malic acid, persulfates and hydrogen peroxide are particularly preferred.

Of these, the organic complex salts of iron (III) are particularly preferred from the viewpoints of rapid processing and the prevention of environmental pollution. The aminopolycarboxylic acids and salts thereof useful for forming the organic complex salts of iron (III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid and glycoletherdiaminetetraacetic acid, as well as biodegradable ethylenediaminedisuccinic acid (SS form), N-(2-carboxylatoethyl)-L-aspartic acid, β-alaninediacetic acid and methyliminodiacetic acid. These compounds may be any of sodium salts, potassium salts, lithium salts and ammonium salts. Of these compounds, ethylenediaminedisuccinic acid (SS form), N-(2-carboxylatoethyl)-L-aspartic acid, β-alaninediacetic acid, ethylenediaminetetraacetic acid, 1,3-diaminopropanetetraacetic acid, methyliminodiacetic acid or complex salts of iron (III) therewith are preferred because of their good photographic properties. These complex salts of ferric irons maybe either used in the form of complex salts, or formed in solutions using ferric salts such as ferric sulfate, ferric chloride, ferric nitrate, ferric ammonium sulfate and ferric phosphate, and chelating agents such as aminopolycarboxylic acids. Further, chelating agents may be used in excess of the formation of ferric complex salts. Of the iron complexes, preferred are aminopolycarboxylic acid-iron complexes.

The amount of the bleaching agent added is determined so that the concentration thereof in a processing solution prepared comes to 0.01 mol/liter to 1.0 mol/liter, preferably 0.03 mol/liter to 0.80 mol/liter, more preferably 0.05 mol/liter to 0.70 mol/liter, and still more preferably 0.07 mol/liter to 0.50 mol/liter.

It is preferred that the bleaching agents, the bleaching-fixing agents and the fixing agents contain various known organic acids (for example, glycolic acid, succinic acid, maleic acid, malonic acid, citric acid and sulfosuccinic acid), organic bases (for example, imidazole and dimethylimidazole), compounds represented by formula (A-a) described in JP-A-9-211819, including 2-picolinic acid, or compounds represented by formula (B-b) described in JP-A-9-211819, including kojic acid. The amount of the compound added is determined so that the concentration thereof in a processing solution prepared comes to preferably 0.005 mol/liter to 3.0 mol/liter, and more preferably 0.05 mol/liter to 1.5 mol/liter.

Then, the fixing agents (including fixing agents for color bleaching-fixing solutions) will collectively be illustrated. Compounds used as these bleaching-fixing agents or fixing agents are known fixing chemicals, that is to say, thiosulfates such as sodium thiosulfate and ammonium thiosulfate, thiocyanates such as sodium thiocyanate and ammonium thiocyanate, thioehter compounds such as ethylenebisthioglycolic acid and 3,6-dithia-1,8-octanediol, and water-soluble agents for dissolving silver halides such as thiourea and derivatives thereof. They can be used either alone or as a mixture of two or more of them. Further, a special bleaching-fixing solution comprising a mixture of a fixing agent described in JP-A-55-155354 and a large amount of a halide such as potassium iodide can also be used. In the invention, the use of thiosulfates, particularly the use of ammonium thiosulfate, is preferred. The concentration of the fixing chemical in the fixing solution and the bleaching-fixing solution which are each prepared from a granular processing agent is preferably from 0.3 mol to 3 mol, and more preferably from 0.5 mol to 2.0 mol, per liter of formulated solution.

The pH range of the bleaching-fixing solution and the fixing solution at the time when prepared is preferably from 3 to 8, and particularly preferably from 4 to 8. When the pH is lower than 3, desilverization is improved, but deterioration of the solution and the conversion of a cyan dye into a lenco dye form are enhanced. Conversely, when the pH is higher than 8, desilverization is retarded, and stains become liable to develop.

In the invention, the pH range of the fixing solution prepared from the granular processing agent is 8 or less, preferably from 2 to 7, and particularly preferably from 2 to 6. When the pH is lower than 2, deterioration of the solution and the conversion of a cyan dye into a lenco dye form are enhanced. Conversely, when the pH is higher than 8, desilverization is retarded, and stains become liable to develop.

For adjusting the pH, the above-mentioned solid acids, the above-mentioned solid alkalis such as potassium hydroxide, sodium hydroxide, lithium hydroxide, lithium carbonate, sodium carbonate and potassium carbonate, and acidic or alkaline buffers can be added as needed.

Further, the bleaching-fixing solutions can also contain various fluorescent brightening agents, antifoaming agents, surfactants or polyvinylpyrrolidone. The fluorescent brightening agents can also be added to the developing solutions containing the above-mentioned color developing agents so as to give a concentration of 0.02 mol/liter to 1.0 mol/liter.

It is preferred that the bleaching-fixing solutions and the fixing solutions contain sulfite ion-releasing compounds such as sulfites (for example, sodium sulfite, potassium sulfite and ammonium sulfite), bisulfites (for example, ammonium bisulfite, sodium bisulfite and potassium bisulfite) and metabisulfites (for example, potassium metabisulfite, sodium metabisulfite and ammonium metabisulfite), and arylsulfinic acids such as p-toulenesulfinic acid and m-carboxybenzenesulfinic acid, as preservatives. These compounds are preferably contained at a concentration of about 0.02 mol/liter to about 1.0 mol/liter in terms of sulfite ions or sulfinic acid ions.

In addition to the above, ascorbic acid, carbonyl bisulfurous acid addition products or carbonyl compounds may be added as preservatives.

After the termination of fixing or bleaching-fixing, processing is carried out in the rinsing bath (that is to say, the alternative stabilizing bath to washing) and the stabilizing bath for image stabilization. This has already been described above.

The descriptions of the constituents of the processing agents applicable in the invention are concluded, and then, the processing stages will be described in which the processing agents of the invention are used.

Development processing applicable in the invention comprises a color developing stage, a desilverization stage, a washing or stabilizing stage and a drying stage, and a supplemental stage such as a rinsing stage, an intermediate washing stage or a neutralization stage can also be inserted between the respective stages. The desilverization stage is performed by one-step processing using a bleaching-fixing solution, or two-step processing comprising a bleaching stage and a fixing stage. Further, in addition to the alternative stabilizing bath to washing, which is substituted for the washing stage, an image stabilizing bath aiming at image stabilization can also be provided between the washing or stabilizing stage and the drying stage.

A processing method used in the invention may be any of rapid development type, low replenishment type and internationally interchangeable standard type processing methods.

When the photographic materials to be processed are color shooting materials such as color negative films and color reversal films, the processing temperature is generally from 30° C. to 40° C. In rapid processing, however, it is from 38° C. to 65° C., and preferably from 40° C. to 55° C. Although the development processing time is from 1 minute to 8 minutes in general processing, it is from 15 seconds to 195 seconds, and preferably from 20 seconds to 150 seconds, in rapid processing. The replenishment rate is 600 ml per $m^2$ of photographic material in standard development. However, in low-replenishment processing, it is from 30 ml to 390 ml, and preferably from 50 ml to 300 ml, per $m^2$ of photographic material. Further, processing can also be carried out at a replenishment rate of 80 ml to 200 ml per $m^2$ of photographic material.

When the photographic materials to be processed are color print materials such as color photographic paper, the processing temperature is generally from 30° C. to 40° C. In rapid processing, however, it is from 38° C. to 65° C. Although the development processing time is from 30 seconds to 3 minutes in general processing, it is from 5 seconds to 45 seconds, and preferably from 5 seconds to 20 seconds, in rapid processing. The replenishment rate is 161 ml per $m^2$ of photographic material in standard development. However, in low-replenishment processing, it is from 10 ml to 150 ml, and preferably from 20 ml to 100 ml, per $m^2$ of photographic material. Further, processing can also be carried out at a replenishment rate of 25 ml to 80 ml per $m^2$ of photographic material.

In color development processing, the development stage is followed by the desilverization stage, and the photographic materials are processed with the bleaching solutions and the bleaching solutions, or the bleaching-fixing solutions.

The bleaching time is usually from 10 seconds to 6 minutes and 30 seconds, preferably from 10 seconds to 4 minutes and 30 seconds, and particularly preferably from 15 seconds to 2 minutes.

The fixing time is usually from 10 seconds to 6 minutes and 30 seconds, preferably from 10 seconds to 4 minutes and 30 seconds, and particularly preferably from 15 seconds to 2 minutes. The processing of the invention is suitable especially for rapid processing in which the fixing time is 90 seconds or less, and particularly from 30 seconds to 80 seconds.

In bleaching-fixing processing, the processing time is from 5 seconds to 240 seconds, and preferably from 10 seconds to 60 seconds.

The processing temperature in the desilverization stage is from 25° C. to 60° C., and preferably from 30° C. to 50° C. In general, each replenishment rate is from 10 ml to 250 ml, preferably from 10 ml to 100 ml, and particularly preferably from 15 ml to 60 ml, per $m^2$ of photographic material. However, when the processing solutions are regenerated and reused, any replenishment rate ranging from the above-mentioned replenishment rate to reduced replenishment can be selected depending on the incorporation of the desilverization stage and how to mix them with newly prepared solutions.

The replenishment rate of the rinsing solution used in the processing of the invention is 850 ml or less, preferably from 200 ml to 800 ml, and more preferably from 200 ml to 500 ml, per $m^2$ of photographic material to be processed, from the viewpoint of stability of the processing solution.

The replenishment rate in the rinsing stage can be widely established depending on the characteristics of the photographic materials (for example, materials used such as couplers), the use, the treating temperature, the number of rinsing bath tanks (the number of steps) and other various conditions. The relationship is the same as that between the amount of water and the number of the washing tanks in the multistage countercurrent system, and can be determined by the method described in *Journal of the Society of Motion Picture and Television Engineers*, 64, 248–253 (May, 1955).

Usually, the number of steps in the multistage countercurrent system is preferably from 3 to 15, and particularly preferably from 3 to 10.

The time taken in the rinsing stage in the processing of the invention is 75 seconds or less, and preferably 65 seconds or less. When the photographic materials to be processed are general-purpose color negative films, short-time processing up to at least 50 seconds is possible. Also in the case of other color photographic materials, shortened processing at approximately similar level is possible.

The processing temperature employed in the rinsing stage is from 25° C. to 60° C., and preferably from 30° C. to 50° C. The rinsing is carried out at a temperature identical to or lower than that of the preceding bleach-fixing solution or fixing solution.

According to the multistage countercurrent system, the replenishment rate of the rinsing solution can be substantially reduced. However, the increased residence time of the rinsing solution in the tanks produces the problem that bacteria propagate in the solution and the resulting suspended matter adheres to the photographic materials. In order to solve such a problem in the invention, it is preferred that the rinsing solutions contain the disinfectants and fungicides as described above.

In the invention, one processing tank may be used for a rinsing bath of a processing apparatus. However, the number of tanks can be increased to about 2 to about 10, and an increase in the number of tanks can decrease the replenishment rate in the rinsing stage. In consideration of the miniaturization of an automatic processor, about 2 to about 6 tanks are preferred. Several tanks may be replenished with the replenisher by division. However, the system in which a tank disposed as downstream as possible to a flow of the photographic material is replenished with the replenisher and an overflowed solution thereof is allowed to flow in a tank precedent to the tank (including the case where tanks are connected to each other with a pipe positioned below a liquid level and the solution passes through the pipe), that is to say, the countercurrent system (multistage countercurrent system), is preferred. The cascade flow system is one belonging thereto. More preferably, the last tank of two or more rinsing bath tanks is replenished with the replenisher, and an overflowed solution is in turn transferred to and allowed to flow in the preceding tank.

Further, in the invention, it is preferred from the viewpoints of a reduction in the total amount of waste liquid and image keeping quality of the photographic materials after processing that all or a part of the rinsing solution scooped out of the rinsing processing tank is introduced into a tank in the preceding stage, usually a fixing tank.

The rinsing stage is followed by drying. From the viewpoint of reducing the amount of water brought in an image film, it is also possible to hasten drying by allowing water to be absorbed by squeezing rolls or cloth immediately after leaving a washing bath. As improving means on the dryer side, it is possible to hasten drying by elevating the temperature of air or changing the shape of a blowing nozzle to blow drying air harder, although this is a matter of course. Further, as described in JP-A-3-157650, it is also possible to hasten drying by adjusting the blowing angle of drying air to the photographic material or removing exhausted air.

The processing methods of the invention using the granular processing agents have been described above, and then, processors for conducting the processing will be illustrated.

The development processing methods according to the invention are carried out using automatic processors. The automatic processors preferably used in the invention will be described below.

In the invention, the transfer linear speed of the automatic processor is preferably 100 mm/seconds, more preferably from 20 mm/seconds to 50 mm/seconds, and particularly preferably from 25 mm/seconds to 45 mm/seconds.

It is preferred that the contact area (opening area) of the processing solutions relating to the invention with air in a processing tank and a replenisher tank is as small as possible. For example, when a value obtained by dividing an opening area ($cm^2$) by a volume ($cm^3$) of the solution in the tank is taken as an opening ratio, the opening ratio is preferably 0.01 ($cm^{-1}$) or less, more preferably 0.005 ($cm^{-1}$) or less, and most preferably 0.001 ($cm^{-1}$) or less.

In order to decreasing the contact area with air, the processing tank and the replenisher tank are preferably provided with solid or liquid means floating on the solutions for preventing contact with air.

Specifically, it is preferred that a plastic float is floated on the solution, or that the solution is covered with a liquid immiscible with and chemically unreactive to the processing solution as examples of the liquids, liquid paraffin and liquid saturated hydrocarbons are preferred.

As means for transferring a leader and the photographic material, the belt transfer system described in JP-A-60-191257, JP-A-60-191258 and JP-A-60-191259 is preferred. Further, for shortening the crossover time and preventing contamination with the processing solution, a crossover rack structure equipped with a contamination-preventing plate is preferred.

Drying conditions of the photographic materials also have an effect on evaporation of the processing solutions. As the drying system, the use of a ceramic hot air heater is preferred, and the supplied air flow is preferably from 4 $m^3$/minute to 20 $m^3$/minute, and particularly preferably from 6 $m^3$/minute to 10 $m^3$/minute.

A thermostat for overheat prevention of the ceramic hot air heater is preferably a system in which the thermostat is actuated by heat transfer, and is preferably mounted upwind or downwind through a radiation fin or a heat transfer portion. The drying temperature is preferably adjusted according to the water content of the photographic materials to be processed, and the optimum temperature is from 45° C. to 55° C. for APS formats and 35-mm-wide films, and from 55° C. to 65° C. for brownie films. In the invention, however, high-temperature drying is possible, so that the drying time can be shortened by high-temperature rapid drying preferably at 60° C. to 90° C., and preferably, a drying temperature of 65° C. to 80° C. can be selected.

In replenishing the processing solution, a replenishing pump is used, which is preferably a bellows replenishing pump. Further, as a method for improving replenishment accuracy, it is effective for preventing backward flow on a stoppage of the pump to make small the diameter of a liquid feed pipe to a replenishing nozzle.

The drying time is preferably from 5 seconds to 2 minutes, more preferably from 5 seconds to 70 seconds, and still more preferably from 30 seconds to 60 seconds.

Although continuous processing by the replenishment system has mainly been described above, there can also be used a depletion processing system in the invention, in which processing is carried out with a definite amount of a processing solution without replenishment, including the development stage and the subsequent stages, and then, the whole amount or a part of the processing solution is replaced with a fresh solution to conduct the processing again.

Then, the photographic materials to which the processing agents used in the invention are applied will be described below.

The photographic materials used in the invention are color photographic materials for shooting, color photographic paper and black-and-white photographic materials for shooting, which are generally used in the photographic market. Each of these photographic materials comprises a support and at least one light-sensitive layer provided thereon. A typical example thereof is a silver halide photographic material comprising a support having provided thereon at least one light-sensitive layer composed of a plurality of silver halide emulsion layers substantially identical in color sensitivity and different in light sensitivity. In particular, high in the effect of the invention is a color negative film.

In the multi-layer silver halide color photographic material for shooting, the light-sensitive layer is a unit light-sensitive layer having color sensitivity to any one of blue light, green light and red light. Layers constituting the unit light-sensitive layer are generally arranged in order of a red-sensitive layer, a green-sensitive layer and a blue-sensitive layer from the side of a support. However, for some purposes, they may be arranged contrary to the above-mentioned order, or may be arranged so as to place a different light-sensitive layer between the layers having the same color sensitivity. Light-insensitive layers may be placed between the above-mentioned silver halide light-sensitive layers, as the most upper layer and as the lowest layer. They may contain couplers described later, DIR compounds, color-mixing inhibitors, etc. In a plurality of silver halide emulsion layers constituting each unit light-sensitive layer, two layers, an emulsion layer of high sensitivity and an emulsion layer of low sensitivity, are preferably arranged in order of lowering the degrees of sensitivity toward a support as described in DE 1,121,470 and GB 923,045. However, the emulsion layer of low sensitivity may be formed far away from the support and that of high sensitivity may be formed close to the support, as described in JP-A-57-112751, JP-A-62-200350, JP-A-62-206541 and JP-A-62-206543.

For example, the light-sensitive layers can be arranged in the order of a low-sensitivity blue-sensitive layer (BL), a high-sensitivity blue-sensitive layer (BH), a high-sensitivity green-sensitive layer (GH), a low-sensitivity green-sensitive layer (GL), a high-sensitivity red-sensitive layer (RH) and a low-sensitivity red-sensitive layer (RL), in the order of BH, BL, GL, GH, RH and RL, or in the order of BH, BL, GH, GL, RL and RH from the farthest side from a support.

The light-sensitive layers can also be arranged in the order of a blue-sensitive layer, GH, RH, GL and RL from the farthest side from a support as described in JP-B-55-34932. Further, they can also be arranged in the order of a blue-sensitive layer, GL, RL, GH and RH from the farthest side from a support as described in JP-A-56-25738 and JP-A-62-63936.

Furthermore, three layers different in light sensitivity maybe arranged so that the upper layer is a silver halide emulsion layer having the highest light sensitivity, the middle layer is a silver halide emulsion layer having a light sensitivity lower than that of the upper layer, the lower layer is a silver halide emulsion layer having a light sensitivity further lower than that of the middle layer, and the sensitivity of the three layers is successively decreased toward a support, as described in JP-B-49-15495. When such three layers different in light sensitivity are arranged, they may be arranged in the order of a medium-sensitivity emulsion layer, a high-sensitivity emulsion layer and a low-sensitivity emulsion layer, which have the same color sensitivity, from the side remote from the support, as described in JP-A-59-202464.

In addition, they may be arranged in the order of a high-sensitivity emulsion layer, a low-sensitivity emulsion layer and a medium-sensitivity emulsion layer, or a low-sensitivity emulsion layer, a medium-sensitivity emulsion layer and a high-sensitivity emulsion layer. In the case of four or more layers, the arrangement may also be changed as described above.

In order to improve color reproducibility, a donor layer (CL) having an interlayer effect different from a main light-sensitive layer such as BL, GL or RL in spectral sensitivity distribution is preferably arranged next to or in the vicinity of the main light-sensitive layer as described in U.S. Pat. Nos. 4,663,271, 4,705,744 and 4,707,436, JP-A-62-160448 and JP-A-63-89850.

A preferred silver halide used in the material for shooting is silver iodobromide, silver iodochloride or silver iodochlorobromide containing about 30 mol % or less of silver iodide. A particularly preferred silver halide is silver iodobromide or silver iodochlorobromide containing about 2 mol % to about 10 mol % of silver iodide.

Silver halide grains contained in the photographic emulsions may be in a regular crystal form such as a cubic, an octahedral or a tetradecahedral form, an irregular crystal form such as a spherical or a tabular form, a form having a crystal defect such as a twin plane, or a combined form thereof.

As to the grain size of the silver halides, grains suitable for each light-sensitive layer are prepared, so that ones having a wide range of grain sizes are used they may be either finely divided grains having a diameter of a projected area of 0.1 $\mu$m to 0.2 $\mu$m, or large-sized grains having a diameter of a projected area of 1.0 $\mu$m to 10 $\mu$m. Further, they may be either polydisperse emulsions or monodisperse emulsions.

In the color photographic materials, fine light-insensitive silver halide grains are preferably used. The fine light-insensitive silver halide grains are fine silver halide grains which are not sensitive to light on imagewise exposure for obtaining dye images and are not substantially developed by their processing, and it is preferred that they are not fogged previously. The fine silver halide grains contain 0 to 100 mol % of silver bromide, and may contain silver chloride and/or silver iodide, as needed. It is preferred that the fine silver halide grains contain 0.5 mol % to 10 mol % of silver iodide. The fine silver halide grains preferably have a mean grain size (a mean value of circle-corresponding diameters of projected areas) of 0.01 $\mu$m to 0.5 $\mu$m, and more preferably 0.02 $\mu$m to 0.2 $\mu$m.

The fine silver halide grains can be prepared in a manner similar to that for preparing conventional light-sensitive silver halide grains. The surfaces of the silver halide grains are not required to be optically sensitized, and are not also required to be spectrally sensitized. It is however preferred that a known stabilizer, such as a triazole, azaindene, benzothiazolium or mercapto compound, or a zinc compound, is previously added to the fine silver halide grains before it is added to a coating solution. Colloidal silver can be added to the fine silver halide grain-containing layer.

The amount of silver applied onto the photographic materials to which the processing agents used in the invention are applied is preferably 6.0 g/m$^2$ or less, and more preferably 4.5 g/m$^2$ or less.

In the photographic materials to which the processing agents used in the invention are applied, the total film thickness of all hydrophilic colloidal layers at the side having the emulsion layer is preferably 28 $\mu$m or less, more preferably 23 $\mu$m or less, still more preferably 18 $\mu$m or less, and particularly preferably 16 $\mu$m or less. The film swelling speed $T_{1/2}$ is preferably 30 seconds or less, and more preferably 20 seconds or less. $T_{1/2}$ is defined as a time required to reach ½ of a saturated film thickness, taking 90% of a maximum thickness of a swelled film reached by processing with a color developing solution at 30° C. for 3 minutes and 15 seconds as the saturated film thickness. The film thickness means a thickness measured after a photographic material is kept for 2 days under conditions of 25° C. and 55% (RH), and $T_{1/2}$ can be measured by using a swellometer described in A. Green et al., *Photogr. Sci. Eng.* Vol.19, No.2, pages 124 to 129. $T_{1/2}$ can be adjusted by adding a hardening agent to gelatin as a binder or changing the above-described aging conditions after coating. The swelling rate is preferably 150% to 400%. The swelling rate can be calculated according to the equation: (maximum swelled film thickness−film thickness)/film thickness, from the maximum swelled film thickness under the above-described conditions.

On the other hand, as to the form of silver halide grains contained in the photographic emulsions preferably used for print preparation, there can be used silver halide grains having a regular crystal form such as a cubic, an octahedral or a tetradecahedral form, an irregular crystal form such as a spherical or a tabular form, or a combined form thereof.

A pair of parallel planes perpendicular to the thickness direction of a tabular grain are called principal planes. In the invention, photographic emulsions containing tabular grains having the {111} planes as the principal planes or tabular grains having the {100} planes as the principal planes are preferably used.

As to the formation of the {111} tabular grains, the use of various crystalline phase controlling agents is disclosed. For example, compounds (compound examples 1 to 42) described in JP-A-2-32 are preferably used.

High silver chloride grains mean grains having a silver chloride content of 80 mol % or more, and the silver chloride content is preferably 95 mol % or more. It is preferred that the grains used in the invention has a so-called core/shell structure in which a core portion is surrounded by a shell portion. The core portion preferably has a silver chloride content of 90 mol % or more. Further, the core portion may be composed of two or more components different in halogen composition. The amount of the shell portion is preferably 50% or less, and particularly preferably 20% or less, based on the volume of the whole grain. The shell portion is preferably composed of silver iodochloride or silver iodobromochloride. The shell portion contains iodine preferably in an amount of 0.5 mol % to 13 mol %, and particularly preferably in an amount of 1 mol % to 13 mol %. The content of silver iodine in the whole grain is preferably 5 mol % or less, and particularly preferably 1 mol % or less.

It is preferred that the silver bromide content of the shell portion is higher than that of the core portion. The silver bromide content is preferably 20 mol % or less, and particularly preferably 5 mol % or less.

There is no particular limitation on the mean grain size (volume-converted sphere-corresponding diameter) of the silver halide grains used in the photographic materials for photographic paper. However, the mean grain size is preferably from 0.1 μm to 0.8 μm, and particularly preferably from 0.1 μm to 0.6 μm. The circle-corresponding diameter of the tabular grain is preferably from 0.2 μm to 1.0 μm. The diameter of the silver halide grain as used herein means a diameter of a circle having an area equal to a projected area of the grain on an electron microscopic photograph. The thickness thereof is 0.2 μm or less, preferably 0.15 μm or less, and particularly preferably 0.12 μm or less. Although the grain size distribution of the silver halide grains may be either polydisperse or monodisperse, it is more preferably monodisperse. In particular, the coefficient of variation of the circle-corresponding diameters of the tabular grains occupying 50% or more of the whole projected area is preferably 20% or less, and ideally 0%.

Both the color photographic materials for shooting and the color photographic materials for print formation will be described below. The silver halide photographic emulsions which can be used in the invention can be prepared, for example, according to methods described in *Research Disclosure* (hereinafter abbreviated as "RD"), No. 17643, pages 22 and 23, "I. Emulsion Preparation and Types" (December, 1978), ibid., No.18716, page 648 (November, 1979), ibid., No. 307105, pages 863 to 865 (November, 1979), P. Glafkides, "Chemie et Phisique Photographique" (Paul Montel, 1967), G. F. Duffin, "Photographic Emulsion Chemistry" (Focal Press, 1966) and V. L. Zelikman et al., "Making and Coating Photographic Emulsion" (Focal Press, 1964).

Monodisperse emulsions described in U.S. Pat. Nos. 3,574,628 and 3,655,394 and GB 1,413,748 are also preferably used.

Further, tabular grains having an aspect ratio of about 3 or more can also be used in the invention. The tabular grains can be readily prepared according to methods described in Gutoff, "Photographic Science and Engineering", Vol. 14, pages 248 to 257 (1970), U.S. Pat. Nos. 4,434,226, 4,414,310, 4,433,048 and 4,439,520, and GB 2,112,157.

The crystal structure may be uniform, or the interior of the grain may be different from the surface thereof in halogen composition. The crystal structure may also be a laminar structure. Silver halide grains different in composition may be joined together by epitaxial bonding. Further, silver halide grains may be joined to compounds other than silver halides, such as silver rhodanide and lead oxide. Furthermore, mixtures of grains having various crystal forms may also be used.

The above-described emulsions may be any of surface latent image type emulsions in which latent images are mainly formed on the surfaces of the grains, internal latent image type emulsions in which latent images are mainly formed in the interiors of the grains and emulsions in which latent images are formed both on the surfaces and in the interiors. However, the emulsions are required to be negative type emulsions. One of the internal latent image type emulsions may be the internal latent image type emulsion of a core/shell type described in JP-A-63-264740. A method for preparing this emulsion is described in JP-A-59-133542. The thickness of a shell of this emulsion is preferably 3 to 40 nm and particularly preferably 5 to 20 nm, though it varies depending on development processing and the like.

The silver halide emulsions subjected to physical ripening, chemical ripening and spectral sensitization are usually employed. Additives used in such stages are described in RD, No. 17643, ibid., No. 18716 and ibid., No. 307105, and corresponding portions thereof are summarized in the following table.

In the color photographic materials to which the processing agents used in the invention are applied, two or more kinds of emulsions which are different in at least one characteristic of the grain size, grain size distribution, halogen composition, grain shape and sensitivity of the light-sensitive silver halide emulsions can be mixed to use them in the same layer.

Silver halide grains described in U.S. Pat. No. 4,082,553, the surfaces of which are fogged, silver halide grains described in U.S. Pat. No. 4,626,498 and JP-A-59-214852, the interiors of which are fogged, and colloidal silver are preferably applied to light-sensitive silver halide emulsion layers and/or substantially light-insensitive hydrophilic colloidal layers. The silver halide grains the surfaces and/or the interiors of which are foggedmean silver halide grains which can be uniformly (non-imagewise) developed, independently of non-exposed or exposed portions of the photographic materials. Methods for preparing these grains are described in U.S. Pat. No. 4,626,498 and JP-A-59-214852. Silver halides forming internal nuclei of core/shell type silver halide grains the interiors of which are fogged may be different in halogen composition. As the silver halide in which the interiors of the grains are fogged, any of silver chloride, silver chlorobromide, silver iodobromide and silver chloroiodobromide can be used.

Photographic additives which can be used in the invention are also described in RDs, and described portions relating thereto are shown in the following table:

| Additive | RD 17643 | RD 18716 | RD 307105 |
|---|---|---|---|
| 1. Chemical Sensitizers | page 23 | page 648, right column | page 866 |
| 2. Sensitivity Accelerators | | page 648, right column | |
| 3. Color Sensitizers, Supersensitizers | pages 23–24 | page 648, right column to page 649, right column | pages 866–868 |
| 4. Brighteners | page 24 | page 647, right column | page 868 |
| 5. Light Absorbers, Filter Dyes, Ultraviolet Absorbers | pages 25–26 | page 649, right column to page 650, left column | page 873 |
| 6. Binders | page 26 | page 651, left column | pages 873–874 |
| 7. Plasticizers, Lubricants | page 27 | page 650, right column | page 876 |
| 8. Coating Aids, Surfactants | pages 26–27 | page 650, right column | pages 875–876 |
| 9. Antistatic Agents | page 27 | page 650, right column | pages 876–877 |
| 10. Matting Agents | | | pages 878–879 |

Various dye-forming couplers can be used in the color photographic materials. However, the following couplers are particularly preferred.

Yellow Couplers: couplers represented by formulas (I) and (II) of EP-A-502,424; couplers represented by formulas (1) and (2) of EP-A-513,496 (particularly, Y-28 found on page 18); couplers represented by formula (I) described in claim 1 of EP-A-568,037; couplers represented by formula (I) found on lines 45 to 55 of column 1 of U.S. Pat. No. 5,066,576; couplers represented by formula (I) described in paragraph 0008 of JP-A-4-274425; couplers described in claim 1 at page 40 of EP-A-498,381 (particularly, D-35 found on page 18); couplers represented by formula (Y) found on page 4 of EP-A-447,969 (particularly, Y-1 (page 17) and Y-54 (page 41)); and couplers represented by formulas (II) to (IV) found on lines 36 to 58 of column 7 of U.S. Pat. No. 4,476,219 (particularly, II-17 and -19 (column 17), and II-24 (column 19)).

Magenta Couplers: L-57 (page 12, lower right column), L-68 (page 12, lower right column) and L-77 (page 13, lower right column) of JP-A-3-39737; A-4-63 (page 134), and A-4-73 and -75 (page 139) of European Patent 456,257; M-4 and M-6 (page 26), and M-7 (page 27) of European Patent 486,965; M-45 (page 19) of EP-A-571,959; M-1 (page 6) of JP-A-5-204106; and M-22 described in paragraph 0237 of JP-A-4-362631.

Cyan Couplers: CX-1, -3, -4, -5, -11, -12, -14 and -15 (pages 14 to 16) of JP-A-4-204843; C-7 and -10 (page 35), -34 and -35 (page 37), (I-1) and (I-17) (pages 42 to 43) of JP-A-4-43345; and couplers represented by formulas (Ia) and (Ib) described in claim 1 of JP-A-6-67385.

Polymer Couplers: P-1 and P-5 (page 11) of JP-A-2-44345.

Preferred couplers which produce forming dyes having appropriate diffusibility are described in U.S. Pat. No. 4,366,237, GB 2,125,570, European Patent 96,570 and DE 3,234,533.

Preferred couplers for correcting unnecessary absorption of forming dyes are yellow-colored cyan couplers represented by formulas (CI), (CII), (CIII) and (CIV) described on page 5 of EP-A-456,257 (particularly, YC-86 found on page 84); yellow-colored magenta couplers ExM-7 (page 202), Ex-1 (page 249) and Ex-7 (page 251) described in EP-A-456,257 described above; magenta-colored cyan coupler CC-9 (column 8) and CC-13 (column 10) described in U.S. Pat. No. 4,833,069; and colorless masking couplers represented by (2) (column 8) of U.S. Pat. No. 4,387,136 and formula (A) described in claim 1 of WO92/11575 (particularly, compounds exemplified at pages 36 to 45).

As compounds releasing photographically useful radicals, there can be added, for example, development retardant-releasing compounds represented by formulas (I), (II), (III), and (IV) described on page 11 of EP-A-378,236; bleaching accelerator-releasing compounds represented by formulas (I) and (I') described on page 5 of EP-A-310,125; ligand-releasing compounds represented by LIG-X described in claim 1 of U.S. Pat. No. 4,555,478; leuco dye-releasing compounds 1 to 6 described in columns 3 to 8 of U.S. Pat. No. 4,749,641; fluorescent dye-releasing compounds described in claim 1 of U.S. Pat. No. 4,774,181; development accelerator- or fogging agent-releasing compounds represented by formulas (1), (2) and (3) described in columns 3 of U.S. Pat. No. 4,656,123; and compounds not releasing dye-producible radicals until removal, which are represented by formula (I) described in claim 1 of U.S. Pat. No. 4,857,447.

As additives other than couplers, there can be added known dispersion mediums for oil-soluble organic compounds, impregnating lattices for oil-soluble organic compounds, scavengers for oxides of developing agents, stainproofing agents, fading inhibitors, hardeners, precursors of development inhibitors, stabilizers, antifoggants, chemical sensitizers, dyes, fine crystal dispersions of dyes, and ultraviolet absorbers.

The invention can be applied to various color photographic materials such as color negative films for general or cinematographic use, color reversal films for slides or TV, color photographic paper and color positive films. Similarly, the invention can also be preferably applied to lens-attached film units described in JP-B-2-32615 and JP-B-U-3-39784 (the term "JP-B-U" as used herein means an "examined Japanese utility model publication").

Supports suitable for the color photographic materials to which the processing agents used in the invention are applied are described, for example, in the above-mentioned RD No. 17643, page 28; RD No. 18716, from page 647, right column to page 648, left column; and RD No. 307105, page 879.

The color photographic materials to which the processing agents used in the invention are applied are each preferably provided with a hydrophilic colloidal layer (referred to as a back layer) having a total dry thickness of 2 to 20 $\mu$m on the side opposite to a side having an emulsion layer. It is preferred that the back layers contain the above-described light absorbers, filter dyes, ultraviolet absorbers, antistatic agents, hardeners, binders, plasticizers, lubricants, coating aids and surfactants. The swelling rate of the back layers is preferably 150% to 500%.

The color photographic materials to which the processing agents used in the invention are applied have magnetic recording layers in many cases.

The magnetic layer is a layer in which an aqueous or organic solvent coating solution of magnetic material particles dispersed in a binder is applied onto a support.

Reflection type supports are used for color photographic paper for color print. As the reflection type support, particularly preferred is a support laminated with a plurality of polyethylene layers or polyester layers and containing a white pigment such as titanium oxide in at least one layer of such water-resistant resin layers (laminate layers).

Further, it is preferred that the above-mentioned water-resistant resin layer contains a fluorescent brightening agent. The fluorescent brightening agent may be dispersed in a hydrophilic colloidal layer of the photographic material. Preferred examples of the fluorescent brightening agents include benzoxazole, coumarin and pyrazoline compounds, and benzoxazolylnaphthalene and benzoxazolylstilbene fluorescent brightening agents are more preferred. Although there is no particular limitation on the amount thereof used, it is preferably from 1 $mg/m^2$ to 100 $mg/m^2$. When the fluorescent brightening agent is mixed with the water-resistant resin, the mixing ratio thereof is preferably from 0.0005% to 3% by weight, and more preferably from 0.001% to 0.5% by weight, based on the resin.

The reflection type support may be a support in which a white pigment-containing hydrophilic colloidal layer is formed on a transparent support or on the reflection type support as described above.

Further, the reflection type support may be a support having a mirror-reflective or secondary diffuse-reflective metal surface.

Cellulose triacetate and polyester supports are used in the color photographic materials for shooting, and details thereof are described in Journal of Technical Disclosure, No. 94-6023 (Japan Institute of Invention and Innovation, Mar. 15, 1994).

Polyesters are formed using diols and aromatic dicarboxylic acids as essential ingredients. The aromatic dicarboxylic acids include 2,6-, 1,5-, 1,4- and 2,7--naphthalendicarboxylic acids, terephthalic acid, isophthalic acid, phthalic acid, and the diols include diethylene glycol, triethylene glycol, cyclohexanedimethanol and bisphenol A. The resulting polymers include homopolymers such as polyethylene terephthalate, polyethylene naphthalate and polycyclohexanedimethanol terephthalate. Particularly preferred is a polyester containing 2,6-naphthalenedicarboxylic acid in an amount of 50 mol % to 100 mol %. Above all, especially preferred is polyethylene 2,6-naphthalate. The average molecular weight thereof ranges from about 5,000 to about 200,000. The Tg of the polyester used in the invention is 50° C. or more, and preferably 90° C. or more.

Ultraviolet absorbers may be added to the polyesters. Further, Diaresin manufactured by Mitsubishi Kasei Corp. and Kayaset manufactured by Nippon Kayaku Co., Ltd., which are commercially available as dyes or pigments for polyesters, can be added to prevent light piping.

The photographic materials to which the processing agents used in the invention are applied are preferably surface treated for adhering the constituent layers to the supports, after application of undercoat layers or directly, by surface-activating treatment such as chemical treatment, mechanical treatment, corona discharge treatment, flame treatment, ultraviolet irradiation treatment, high-frequency treatment, glow discharge treatment, active plasma treatment, laser treatment, mixed acid treatment or ozone oxidation treatment. Above all, preferred are ultraviolet irradiation treatment, flame treatment, corona discharge treatment and glow discharge treatment.

Further, antistatic agents are preferably used to the photographic materials to which the processing agents used in the invention are applied. The antistatic agents include carboxylicacids, carboxylates, sulfonate-containing polymers, cationic polymers and ionic surfactant compounds.

Most preferred as the antistatic agents are fine particles of at least one crystalline metal oxide selected from zinc oxide, silicon dioxide, titanium dioxide, alumina, indium oxide, magnesium oxide, barium oxide, manganese oxide and vanadium oxide, which has a volume resistivity of $10^7\Omega\cdot cm$ or less, preferably $10^5\Omega\cdot cm$ or less, and a particle size of 0.001 $\mu m$ to 1.0 $\mu m$, or fine particles of a double oxide thereof (Sb, P, B, In, S, Si, C, etc.), and further, fine particles of a sol-like metal oxide or a double oxide thereof. The content thereof in the photographic material is preferably from 5 $mg/m^2$ to 500 $mg/m^2$, and particularly preferably from 10 $mg/m^2$ to 350 $mg/m^2$. The amount ratio of the conductive crystalline oxide or the double oxide thereof to a binder is preferably from 1/300 to 100/1, and more preferably from 1/100 to 100/5.

It is preferred that the color photographic materials have slipperiness. Lubricant-containing layers are preferably used on both of a light-sensitive layer face and a back face. The slipperiness is preferably from 0.01 to 0.25 in the coefficient of dynamic friction. The measurement at this time indicates a value at the time when transferred at 60 cm/minute with respect to a stainless ball having a diameter of 5 mm (25° C., 60% RH). In this evaluation, the replacement of the object material to the light-sensitive face also results in an approximately similar level of a value.

The lubricants available in the invention are polyorganosiloxanes, higher fatty acid amides, metal salts of higher fatty acids, and esters of higher fatty acids and higher alcohols. The polyorganosiloxanes available in the invention include polydimethylsiloxane, polydiethylsiloxane, polystyrylmethylsiloxane and polymethylphenylsiloxane. They are preferably added to an outermost layer or a back layer of the emulsion layers. In particular, polydimethylsiloxane and long-chain alkyl group-containing esters are preferred.

It is preferred that the color photographic materials have matte agents. Although the matte agents may be added to either an emulsion face or a back face, it is particularly preferred that they are added to an outermost layer on the emulsion side. The matte agents may be either soluble or insoluble in processing solutions, and both are preferably used together. For example, polymethyl methacrylate, poly (methyl methacrylate/methacrylic acid) (9/1 or 5/5 (molar ratio)) and polystyrene particles are preferred. The particle size is preferably from 0.8 $\mu m$ to 10 $\mu m$. The narrower particle size distribution is preferred, and it is preferred that 90% or more of all particles are included between 0.9 time and 1.1 times the mean particle size. For enhancing matting properties, it is also preferred that fine particles having a size of 0.8 $\mu m$ or less are added at the same time. Examples of the fine particles include polymethyl methacrylate (0.2 $\mu m$), poly(methyl methacrylate/methacrylic acid) (9/1 (molar ratio), 0.3 $\mu m$), polystyrene particles (0.25 $\mu m$) and colloidal silica (0.03 $\mu m$).

EXAMPLES

The invention will be illustrated in greater detail with reference to the following examples, which are, however, not to be construed as limiting the invention.

Example 1

Test of Photographic Properties

1. Preparation of Photographic Materials for Test

[Supports]

Supports used in this example were prepared by the following method.

1) First Layer and Undercoat Layer

90-$\mu$m thick polyethylene naphthalate supports were each glow discharge treated on both faces thereof at a treating atmospheric pressure of 2.66×10 Pa, a partial pressure of $H_2O$ in atmospheric gas of 75%, a discharge frequency of 30 kHz, an output of 2500 W and an intensity of 0.5 kV·A·minute/$m^2$. Each support thus obtained was coated with a coating solution having the following composition in an amount coated of 5 ml/$m^2$ by a bar coating method described in JP-B-58-4589.

| | |
|---|---|
| Dispersion of Fine Conductive Particles (10% aqueous dispersion of $SnO_2/Sb_2O_5$ particles, secondary aggregates of primary particles having a size of 0.005 $\mu$m, mean particle size of the aggregates: 0.05 $\mu$m) | 50 parts by weight |
| Gelatin | 0.5 part by weight |
| Water | 49 parts by weight |
| Polyglycerol Polyglycidyl Ether | 0.16 part by weight |
| Poly (degree of polymerization 20) oxyethylene Sorbitan Monolaurate | 0.1 part by weight |

After formation of the first layer, each substrate was wound around a stainless steel core having a diameter of 20 cm, and heat treated at 110° C. (Tg of the PEN support: 119° C.) for 48 hours, followed by annealing treatment. Then, each support thus treated was coated with a coating solution having the following composition as an undercoat layer for an emulsion in an amount coated of 10 ml/$m^2$ on the side opposite to the first layer side by a bar coating method.

| | |
|---|---|
| Gelatin | 1.01 parts by weight |
| Salicylic Acid | 0.30 part by weight |
| Resorcin | 0.40 part by weight |
| Poly (degree of polymerization 10) oxyethylene Nonyl Phenyl Ether | 0.11 part by weight |
| Water | 3.53 parts by weight |
| Methanol | 84.57 parts by weight |
| n-Propanol | 10.08 parts by weight |

Further, second and third layers described later were formed on the first layer in this order, and finally, a color negative photographic material having a composition described later was applied onto the opposite side in multiple layers, thereby preparing a transparent magnetic recording medium with a silver halide emulsion layer.

2) Second Layer (Transparent Magnetic Recording Layer)

(1) Dispersion of Magnetic Material

Co-coated $\gamma$-$Fe_2O_3$ magnetic material (average major axis length: 0.25 $\mu$m, $S_{BET}$: 39 $m^2$/g, Hc: 6.56×$10^4$ A/m, $\sigma s$: 77.1 $Am^2$/kg, $\sigma r$: 37.4 $Am^2$/kg) (1100 parts by weight), 220 parts by weight of water and 165 parts by weight of a silane coupling agent [3-(poly(degree of polymerization 10)oxyethynyl)oxypropyl trimethoxysilane] were sufficiently kneaded in an open kneader for 3 hours. The resulting crudely dispersed viscous solution was dried at 70° C. for a whole day and night to remove water, followed by heat treatment at 110° C. for 1 hour to prepare surface-treated magnetic particles.

The magnetic particles were further kneaded again according to the following formulation in an open kneader for 4 hours.

| | |
|---|---|
| Above-Mentioned Surface-Treated Magnetic Particles | 855 g |
| Diacetylcellulose | 25.3 g |
| Methyl Ethyl Ketone | 136.3 g |
| Cyclohexanone | 136.3 g |

The magnetic particles were further finely dispersed according to the following formulation in a sand mill (sand mill of ¼ G) at 2000 rpm for 4 hours. Glass beads having a size of 1 mm were used as a medium.

| | |
|---|---|
| Above-Mentioned Kneaded Solution | 45 g |
| Diacetylcellulose | 23.7 g |
| Methyl Ethyl Ketone | 127.7 g |
| Cyclohexanone | 127.7 g |

Further, a magnetic material-containing intermediate solution was prepared according to the following formulation.

(2) Preparation of Magnetic Material-Containing Intermediate Solution

| | |
|---|---|
| Above-Mentioned Finely Dispersed Solution of Magnetic Material | 674 g |
| Diacetylcellulose Solution (solid content: 4.34%, solvent: methyl ethyl ketone/cyclohexanone = 1/1) | 24280 g |
| Cyclohexanone | 46 g |

These were mixed and stirred with a disperser to prepare a magnetic material-containing intermediate solution.

An $\alpha$-alumina abrasive dispersion was prepared according to the following formulation.

(a) SUMICORUMDUM AA-1.5 (Mean Primary Particle Size: 1.5 $\mu$m, Specific Surface Area: 1.3 $m^2$/g)

| Preparation of Particle Dispersion | |
|---|---|
| SUMICORUMDUM AA-1.5 | 152 g |
| Silane Coupling Agent KBM903 (manufactured by Shin-Etsu Silicone Co., Ltd.) | 0.48 g |
| Diacetylcellulose Solution (solid content: 4.5%, solvent: methyl ethyl ketone/cyclohexanone = 1/1) | 227.52 g |

Using a ceramic-coated sand mill (sand mill of ¼ G), fine dispersion was carried out according to the above-mentioned formulation at 800 rpm for 4 hours. Zirconia beads having a size of 1 mm were used as a medium.

(b) Dispersion of Colloidal Silica Particles (Minute Particles) "MEK-ST" manufactured by Nissan Chemical Industries, Ltd. was used.

This is a dispersion of colloidal silica having a mean primary particle size of 0.015 μm, using methyl ethyl ketone as a dispersing medium, and the solid content thereof is 30%.

(3) Preparation of Coating Solution for Second Layer

| | |
|---|---|
| Above-Mentioned Magnetic Material-Containing Intermediate Solution | 19053 g |
| Diacetylcellulose Solution (solid content: 4.5%, solvent: methyl ethyl ketone/cyclohexanone = 1/1) | 264 g |
| Colloidal Silica Dispersion "MEK-ST" (Dispersion b) (solid content: 30%) | 128 g |
| AA-1.5 Dispersion (Dispersion a) | 12 g |
| Diluted Solution of MILLIONATE MR-400 (manufactured by Nippon Polyurethane Industry Co., Ltd.) (solid content: 20%, solvent: methyl ethyl ketone/cyclohexanone = 1/1) | 203 g |
| Methyl Ethyl Ketone | 170 g |
| Cyclohexanone | 170 g |

A coating solution obtained by mixing and stirring the above was applied with a wire bar so as to give an amount coated of 29.3 ml/m$^2$. Drying was performed at 110° C. The thickness of a magnetic layer after drying was 1.0 μm.

3) Third Layer (Layer Containing Higher Fatty Acid Ester Lubricant)

(1) Preparation of Dispersed Stock Solution of Lubricant

The following solution was prepared by heating at 100° C., and added to solution b, followed by dispersing with a high-pressure homogenizer to prepare a dispersed stock solution of a lubricant.

| | |
|---|---|
| Solution a | |
| Following Compound $C_6H_{13}CH(OH)(CH_2)_{10}COOC_{50}H_{101}$ | 399 parts by weight |
| Following Compound n-$C_{50}H_{101}O(CH_2CH_2O)_{16}H$ | 171 parts by weight |
| Cyclohexanone | 830 parts by weight |
| Solution b | |
| Cyclohexanone | 8600 parts by weight |

(2) Preparation of Spherical Inorganic Particle Dispersion

Spherical inorganic particle dispersion c1 was prepared according to the following formulation:

| | |
|---|---|
| Isopropyl Alcohol | 93.54 parts by weight |
| Silane Coupling Agent KBM903 (manufactured by Shin-Etsu Silicone Co., Ltd.) Compound 1-1: $(CH_3O)_3Si—(CH_2)_3—NH_2$ | 5.53 parts by weight |
| Compound 1 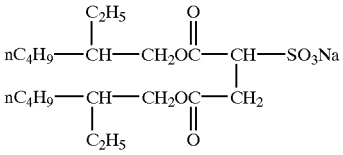 | 2.93 parts by weight |
| SEA HOSTAR KEP50 (spherical amorphous silica, mean particle size: 0.5 μm, manufactured by Nippon Shokubai Kagaku Kogyo Co., Ltd.) | 88.00 parts by weight |
| Diacetone Alcohol | 252.93 parts by weight |

The above-mentioned solution was dispersed using an ultrasonic homogenizer "SONIFIER 450" manufactured by BRANSON for 3 hours, with stirring under ice cooling, thereby completing spherical inorganic particle dispersion c1.

(3) Preparation of Spherical Organic Polymer Particle Dispersion

Spherical organic polymer particle dispersion c2 was prepared according to the following formulation:

| | |
|---|---|
| XC99-A8808 (manufactured by Toshiba Silicone Co., Ltd., spherical cross-linked polysiloxane particles, mean particle size: 0.9 μm) | 60 parts by weight |
| Methyl Ethyl Ketone | 120 parts by weight |
| Cyclohexanone (solid content: 20%, solvent: methyl ethyl ketone/cyclohexanone = 1/1) | 120 parts by weight |

The above-mentioned solution was dispersed using an ultrasonic homogenizer "SONIFIER 450" manufactured by BRANSON for 2 hours, with stirring under ice cooling, thereby completing spherical inorganic particle dispersion c2.

(4) Preparation of Coating Solution for Third Layer

The following were added to 542 g of the above-mentioned dispersed stock solution of the lubricant to prepare a coating solution for a third layer.

| | |
|---|---|
| Diacetone Alcohol | 5950 g |
| Cyclohexanone | 176 g |
| Ethyl Acetate | 1700 g |
| Above-Mentioned SEA HOSTAR KEP50 Dispersion c1 | 53.1 g |
| Above-Mentioned Spherical Organic Polymer Particle Dispersion c2 | 300 g |
| FC431 (manufactured by 3M Co., solid content: 50%, solvent: ethyl acetate) | 2.65 g |
| BYK310 (manufactured by BYK Chemijapan Co., Ltd., solid content: 25%) | 5.3 g |

The above-mentioned coating solution for the third layer was applied onto the second layer in an amount of 10.35 ml/m$^2$, and dried at 110° C., followed by further drying at 97° C. for 3 minutes.

[Light-Sensitive Layers]

Then, respective layers having the following compositions were formed in layers on the side opposite to the back layer obtained above to prepare a color negative film.

(Compositions of Light-Sensitive Layers)

Numerals corresponding to respective components indicate the coated amount represented by the g/m$^2$ unit. For silver halides, numerals indicate the coated amount converted to silver. As to specific compounds represented by symbols in the following, chemical formulas thereof are shown later.

| | | |
|---|---|---|
| First Layer (First Antihalation Layer) | | |
| Black Colloidal Silver | Silver | 0.070 |
| Gelatin | | 0.608 |
| ExM-1 | | 0.035 |
| F-8 | | 0.001 |
| HBS-1 | | 0.050 |
| HBS-2 | | 0.002 |
| Second Layer (Second Antihalation Layer) | | |
| Black Colloidal Silver | Silver | 0.089 |
| Gelatin | | 0.632 |
| ExF-1 | | 0.002 |
| F-8 | | 0.001 |
| Third Layer (Intermediate Layer) | | |
| Cpd-1 | | 0.082 |
| HBS-1 | | 0.043 |
| Gelatin | | 0.422 |
| Fourth Layer (Low Sensitivity Red-Sensitive Emulsion Layer) | | |
| Em-D | Silver | 0.577 |
| Em-C | Silver | 0.347 |
| ExC-1 | | 0.263 |
| ExC-2 | | 0.015 |
| ExC-3 | | 0.155 |
| ExC-4 | | 0.144 |
| ExC-5 | | 0.035 |
| ExC-6 | | 0.015 |
| Cpd-4 | | 0.025 |
| UV-2 | | 0.047 |
| UV-3 | | 0.086 |
| UV-4 | | 0.018 |
| HBS-1 | | 0.245 |
| HBS-5 | | 0.038 |
| Gelatin | | 0.994 |
| Fifth Layer (Medium Sensitivity Red-Sensitive Emulsion Layer) | | |
| Em-B | Silver | 0.431 |
| Em-C | Silver | 0.432 |
| ExC-1 | | 0.110 |
| ExC-2 | | 0.027 |
| ExC-3 | | 0.007 |
| ExC-4 | | 0.075 |
| ExC-5 | | 0.007 |
| ExC-6 | | 0.021 |
| ExC-8 | | 0.010 |
| ExC-9 | | 0.005 |
| Cpd-2 | | 0.032 |
| Cpd-4 | | 0.020 |
| HBS-1 | | 0.098 |
| Gelatin | | 0.802 |
| Sixth Layer (High Sensitivity Red-Sensitive Emulsion Layer) | | |
| Em-A | Silver | 1.214 |
| EXC-1 | | 0.070 |
| ExC-3 | | 0.005 |
| ExC-6 | | 0.026 |
| ExC-8 | | 0.109 |
| ExC-9 | | 0.020 |
| Cpd-2 | | 0.068 |
| Cpd-4 | | 0.020 |
| HBS-1 | | 0.231 |
| Gelatin | | 1.174 |
| Seventh Layer (Intermediate Layer) | | |
| Cpd-1 | | 0.073 |
| Cpd-6 | | 0.002 |
| HBS-1 | | 0.037 |
| Polyethyl Acrylate Latex | | 0.088 |
| Gelatin | | 1.174 |
| Eighth Layer (Layer for Imparting Interlayer Effect to Red-Sensitive Layer) | | |
| Em-J | Silver | 0.153 |
| Em-K | Silver | 0.153 |

-continued

| | | |
|---|---|---|
| ExM-2 | | 0.086 |
| ExM-3 | | 0.002 |
| ExM-4 | | 0.025 |
| ExY-4 | | 0.041 |
| ExC-7 | | 0.026 |
| HBS-1 | | 0.218 |
| HBS-3 | | 0.003 |
| Gelatin | | 0.649 |
| Ninth Layer (Low Sensitivity Green-Sensitive Emulsion Layer) | | |
| Em-H | Silver | 0.329 |
| Em-G | Silver | 0.333 |
| Em-I | Silver | 0.088 |
| ExM-2 | | 0.360 |
| ExM-3 | | 0.055 |
| ExY-3 | | 0.012 |
| ExC-7 | | 0.008 |
| HBS-1 | | 0.362 |
| HBS-3 | | 0.010 |
| HBS-4 | | 0.200 |
| Gelatin | | 1.403 |
| Tenth Layer (Medium Layer Green-Sensitive Emulsion Layer) | | |
| Em-F | Silver | 0.394 |
| ExM-2 | | 0.049 |
| ExM-3 | | 0.034 |
| ExY-3 | | 0.007 |
| ExC-7 | | 0.012 |
| ExC-8 | | 0.010 |
| HBS-1 | | 0.060 |
| HBS-3 | | 0.002 |
| HBS-4 | | 0.020 |
| Gelatin | | 0.474 |
| Eleventh Layer (High Sensitivity Green-Sensitive Emulsion Layer) | | |
| Em-E | Silver | 0.883 |
| ExC-6 | | 0.007 |
| ExC-8 | | 0.011 |
| ExM-1 | | 0.021 |
| ExM-2 | | 0.092 |
| ExM-3 | | 0.015 |
| Cpd-3 | | 0.005 |
| Cpd-5 | | 0.010 |
| HBS-1 | | 0.176 |
| HBS-3 | | 0.003 |
| HBS-4 | | 0.070 |
| Polyethyl Acrylate Latex | | 0.099 |
| Gelatin | | 0.916 |
| Twelfth Layer (Yellow Filter Layer) | | |
| Cpd-1 | | 0.092 |
| Solid Disperse Dye ExF-2 | | 0.088 |
| HBS-1 | | 0.049 |
| Gelatin | | 0.603 |
| Thirteenth Layer (Low Sensitivity Blue-Sensitive Emulsion Layer) | | |
| Em-O | Silver | 0.112 |
| Em-M | Silver | 0.320 |
| Em-N | Silver | 0.240 |
| ExC-1 | | 0.049 |
| ExC-7 | | 0.013 |
| ExY-1 | | 0.002 |
| ExY-2 | | 0.693 |

-continued

| | | |
|---|---|---|
| ExY-4 | | 0.058 |
| HBS-1 | | 0.231 |
| Gelatin | | 1.553 |
| Fourteenth Layer (High Sensitivity Blue-Sensitive Emulsion Layer) | | |
| Em-L | Silver | 0.858 |
| ExY-2 | | 0.357 |
| ExY-4 | | 0.068 |
| HBS-1 | | 0.124 |
| Gelatin | | 0.949 |
| Fifteenth Layer (First Protective Layer) | | |
| Silver Idobromide Emulsion of 0.07 μm | Silver | 0.245 |
| UV-1 | | 0.313 |

-continued

| | | |
|---|---|---|
| UV-2 | | 0.156 |
| UV-3 | | 0.222 |
| UV-4 | | 0.022 |
| F-18 | | 0.007 |
| S-1 | | 0.068 |
| HBS-1 | | 0.175 |
| HBS-4 | | 0.020 |
| Gelatin | | 1.950 |
| Sixteenth Layer (Second Protective Layer) | | |
| H-1 | | 0.356 |
| B-1 (size: 1.7 μm) | | 0.050 |
| B-2 (size: 1.7 μm) | | 0.150 |
| B-3 | | 0.050 |
| S-1 | | 0.200 |
| Gelatin | 0.675 | |

In addition, for improving keeping quality, processability, pressure resistance, mold proofing, bacteria proofing, antistatic quality and coating quality, the respective layers appropriately contained W-1 to W-3, B-4 to B-6, F-1 to F-17, lead salts, platinum salts, iridium salts and rhodium salts.

Preparation of Organic Solid Disperse Dye Dispersion

ExF-2 of the twelfth layer was dispersed by the following method.

| | |
|---|---|
| Wet Cake of ExF-2 (containing 17.6% by weight of water) | 2.800 kg |
| Sodium Octylphenyldiethoxymethanesulfonate (31 wt % aqueous solution) | 0.376 kg |

-continued

| | |
|---|---|
| F-15 (7% aqueous solution) | 0.011 kg |
| Water | 4.020 kg |
| Total | 7.210 kg |

(The pH was adjusted to 7.2 with NaOH.)

A slurry having the above-mentioned composition was crudely dispersed by stirring with a dissolver, and then, dispersed by use of an LMK-4 agitator mill at aperipheral speed of 10 m/s, a discharge of 0.6 kg/min and a filling rate of 0.3-mm diameter zirconia beads of 80% until the absorbance ratio of the solution reached 0.29, thereby obtaining a dispersion of fine solid particles. The fine dye particles had a mean particle size of 0.29 μm.

TABLE 1

| Emulsion Name | Mean Iodine (mol %) | Sphere-Corresponding Diam. (μm) | Aspect Ratio | Circle-Corresponding Diam. (μm) | Particle Thickness (μm) | Form |
|---|---|---|---|---|---|---|
| Em-A | 4 | 0.92 | 14 | 2 | 0.14 | Tabular |
| Em-B | 5 | 0.8 | 12 | 1.6 | 0.13 | Tabular |
| Em-C | 4.7 | 0.51 | 7 | 0.85 | 0.12 | Tabular |
| Em-D | 3.9 | 0.37 | 2.7 | 0.4 | 0.15 | Tabular |
| Em-E | 5 | 0.92 | 14 | 2 | 0.14 | Tabular |
| Em-F | 5.5 | 0.8 | 12 | 1.6 | 0.13 | Tabular |
| Em-G | 4.7 | 0.51 | 7 | 0.85 | 0.12 | Tabular |
| Em-H | 3.7 | 0.49 | 3.2 | 0.58 | 0.18 | Tabular |
| Em-I | 2.8 | 0.29 | 1.2 | 0.27 | 0.23 | Tabular |
| Em-J | 5 | 0.8 | 12 | 1.6 | 0.13 | Tabular |
| Em-K | 3.7 | 0.47 | 3 | 0.53 | 0.18 | Tabular |
| Em-L | 5.5 | 1.4 | 9.8 | 2.6 | 0.27 | Tabular |
| Em-M | 8.8 | 0.64 | 5.2 | 0.85 | 0.16 | Tabular |
| Em-N | 3.7 | 0.37 | 4.6 | 0.55 | 0.12 | Tabular |
| Em-O | 1.8 | 0.19 | — | — | — | Cubic |

In Table 1, emulsions A to C contained spectral sensitizing dyes 1 to 3 in optimal amounts, and were subjected to optimum gold sensitization, sulfur sensitization and selenium sensitization. Emulsions E to G contained spectral sensitizing dyes 4 to 6 in optimal amounts, and were subjected to optimum gold sensitization, sulfur sensitization and selenium sensitization. Emulsion J contained spectral sensitizing dyes 7 and 8 in optimal amounts, and was subjected to optimum gold sensitization, sulfur sensitization and selenium sensitization. Emulsion L contained spectral sensitizing dyes 9 to 11 in optimal amounts, and were subjected to optimum gold sensitization, sulfur sensitization and selenium sensitization. Emulsion O contained spectral sensitizing dyes 10 to 12 in optimal amounts, and were subjected to optimum gold sensitization, sulfur sensitization and selenium sensitization. Emulsions D, H, I, K, M and N contained spectral sensitizing dyes described in Table 2 in optimal amounts, and were subjected to optimum gold sensitization, sulfur sensitization and selenium sensitization.

TABLE 2

| Emulsion Name | Sensitizing Dye | Amount Added (mol/mol silver) |
|---|---|---|
| Em-D | Sensitizing Dye 1 | $5.44 \times 10^{-4}$ |
| | Sensitizing Dye 2 | $2.35 \times 10^{-4}$ |
| | Sensitizing Dye 3 | $7.26 \times 10^{-5}$ |
| Em-H | Sensitizing Dye 8 | $6.52 \times 10^{-4}$ |

TABLE 2-continued

| Emulsion Name | Sensitizing Dye | Amount Added (mol/mol silver) |
|---|---|---|
| | Sensitizing Dye 13 | $1.35 \times 10^{-4}$ |
| | Sensitizing Dye 6 | $2.48 \times 10^{-5}$ |
| Em-I | Sensitizing Dye 8 | $6.09 \times 10^{-4}$ |
| | Sensitizing Dye 13 | $1.26 \times 10^{-4}$ |
| | Sensitizing Dye 6 | $2.32 \times 10^{-5}$ |
| Em-K | Sensitizing Dye 7 | $6.27 \times 10^{-4}$ |
| | Sensitizing Dye 8 | $2.24 \times 10^{-4}$ |
| Em-M | Sensitizing Dye 9 | $2.43 \times 10^{-4}$ |
| | Sensitizing Dye 10 | $2.43 \times 10^{-4}$ |
| | Sensitizing Dye 11 | $2.43 \times 10^{-4}$ |
| Em-N | Sensitizing Dye 9 | $3.28 \times 10^{-4}$ |
| | Sensitizing Dye 10 | $3.28 \times 10^{-4}$ |
| | Sensitizing Dye 11 | $3.28 \times 10^{-4}$ |

Chemical formulas of the sensitizing dyes described in Table 2 are shown below:

Sensitizing Dye 1

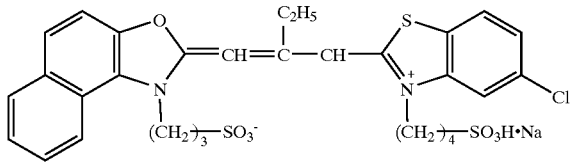

Sensitizing Dye 2

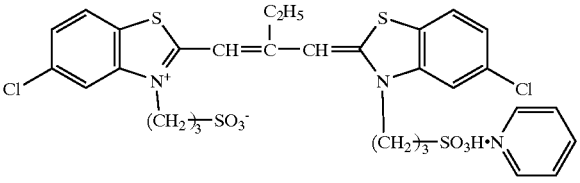

Sensitizing Dye 3

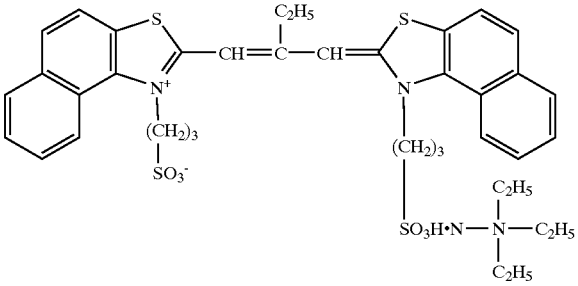

Sensitizing Dye 4

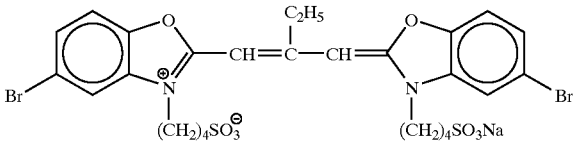

Sensitizing Dye 5

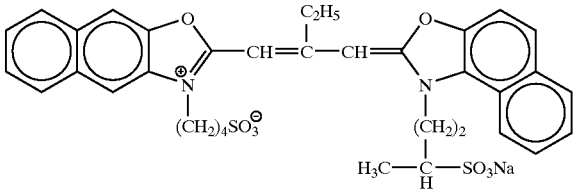

-continued

Sensitizing Dye 6

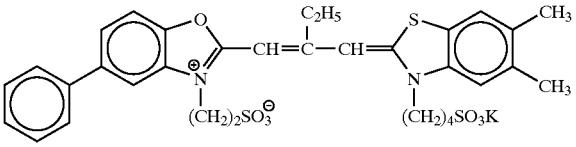

Sensitizing Dye 7

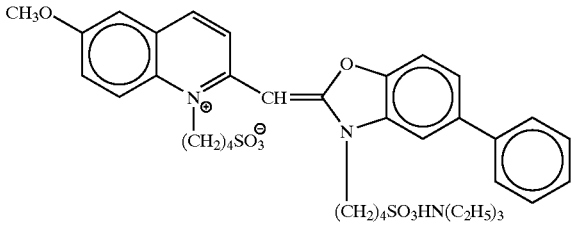

Sensitizing Dye 8

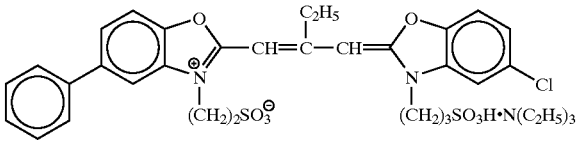

Sensitizing Dye 9

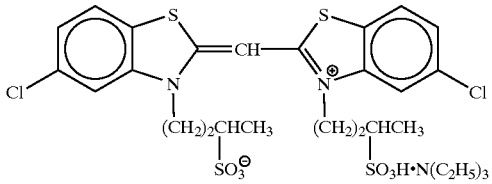

Sensitizing Dye 10

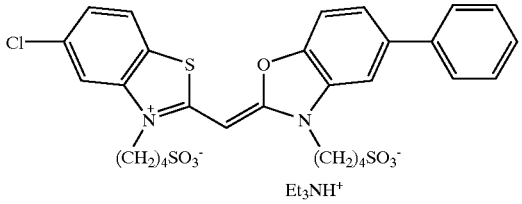

Sensitizing Dye 11

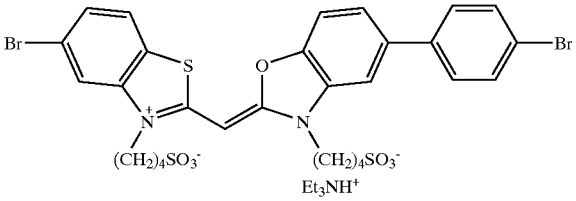

Sensitizing Dye 12

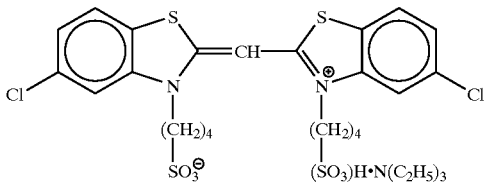

-continued

Sensitizing Dye 13

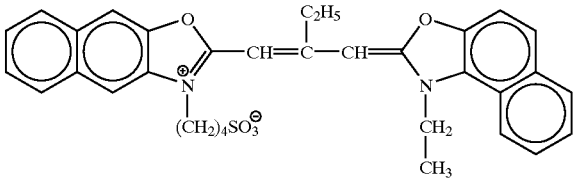

Low molecular weight gelatin was used for the preparation of the tabular grains according to the examples described in JP-A-1-158426.

Emulsions A to K contained Ir and Fe in optimum amounts

Emulsions L to O were subjected to reduction sensitization in preparing the particles.

In the tabular grains, dislocation lines as described in JP-A-3-237450 were observed under a high-voltage electron microscope.

In emulsions A to C and J, dislocation was introduced using iodine ion releasing agents according to the examples described in JP-A-6-11782.

In emulsion E, dislocation was introduced using silver iodide particles prepared just before addition thereof in a separate chamber equipped with a magnetic coupling induction type stirrer described in JP-A-10-43570.

The compounds used in the respective layers are shown below:

ExC-1

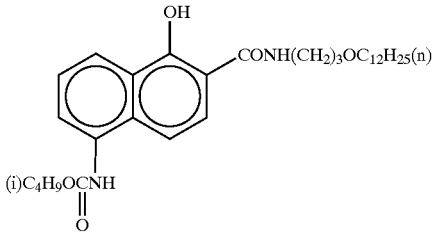

ExC-2

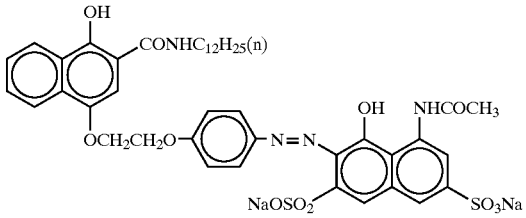

ExC-3

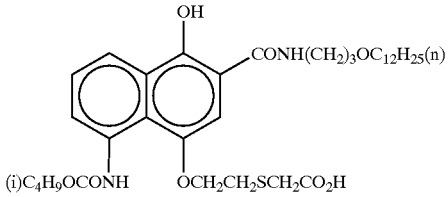

ExC-4

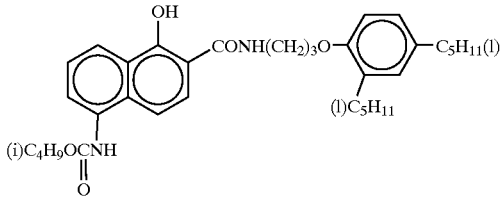

ExC-5

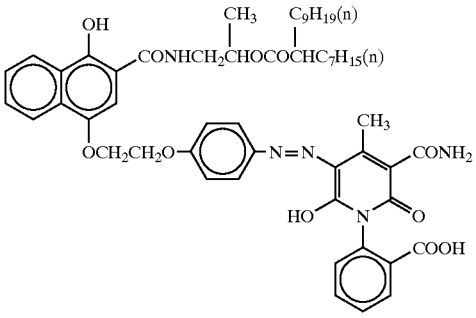

ExC-6

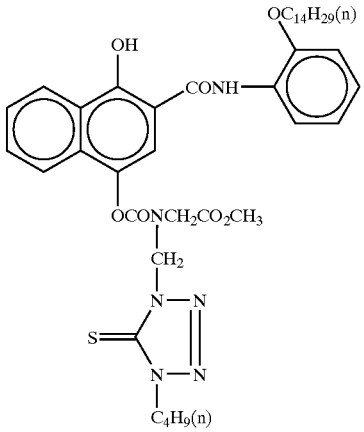

ExC-7

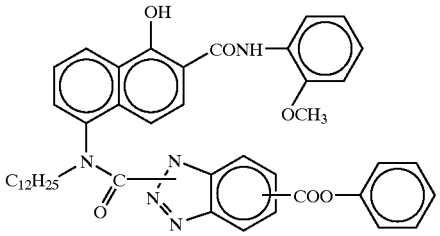

ExC-8

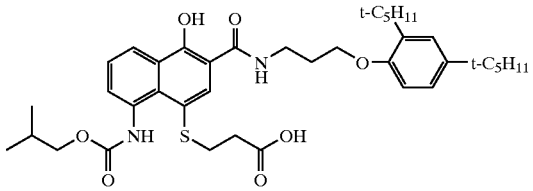

-continued
ExC-9
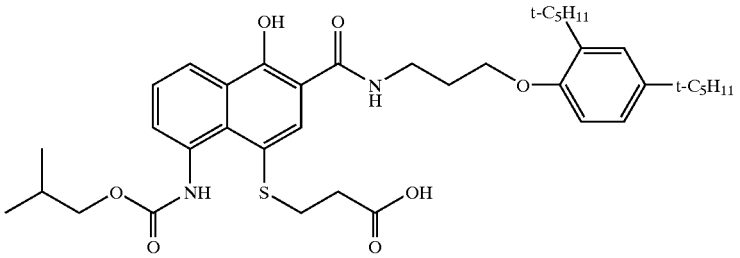
ExM-1
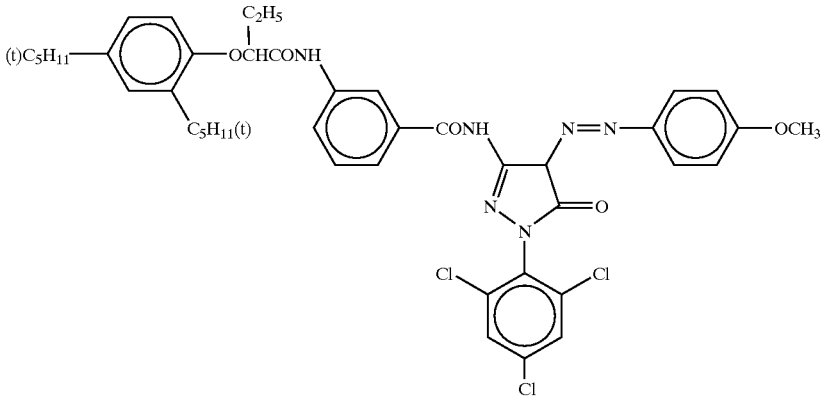
ExM-2
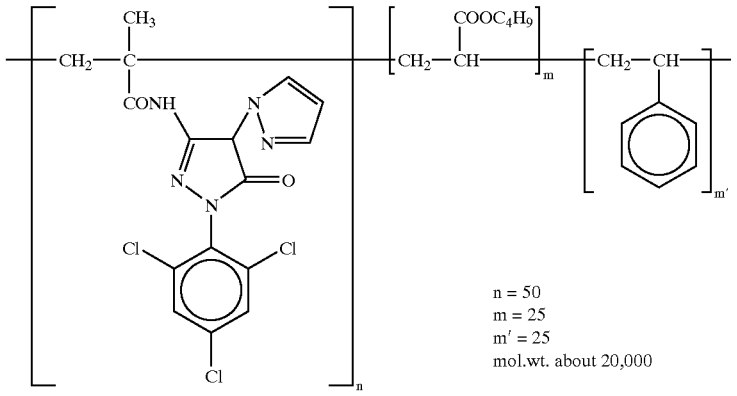
ExM-3
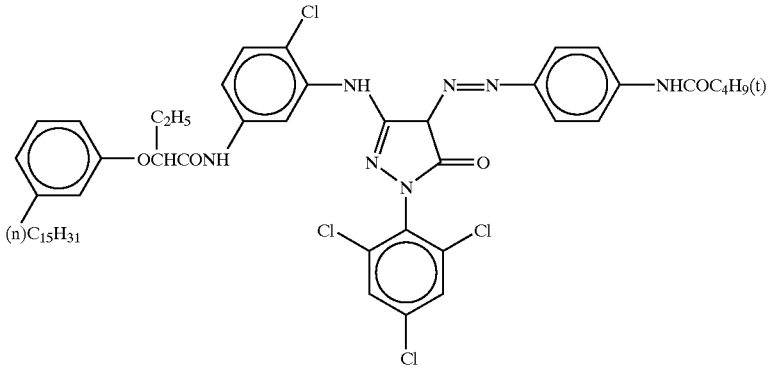

-continued
ExM-4
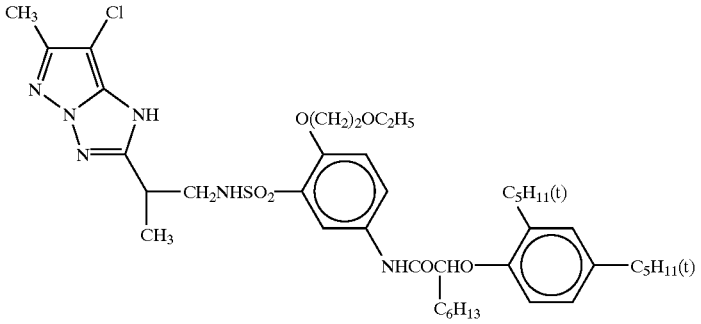
ExY-1
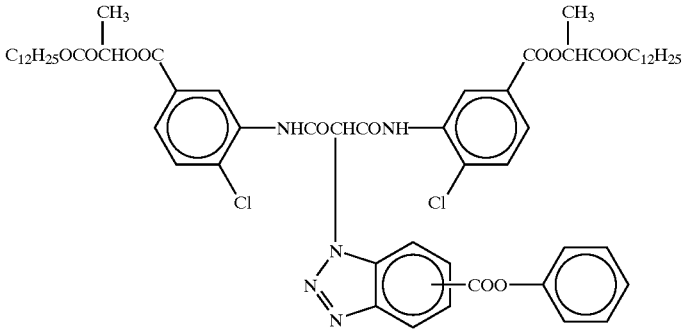
ExY-2
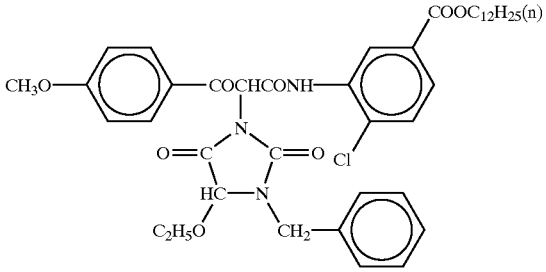
ExY-3
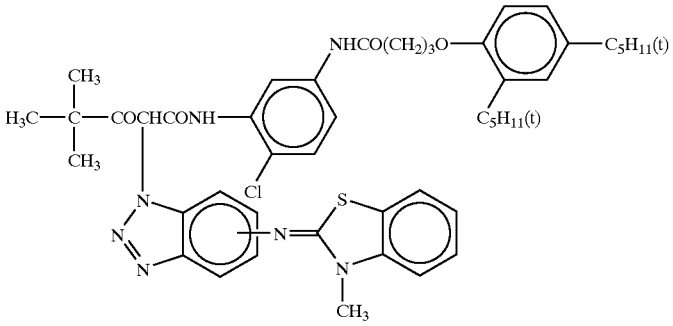
ExY-4
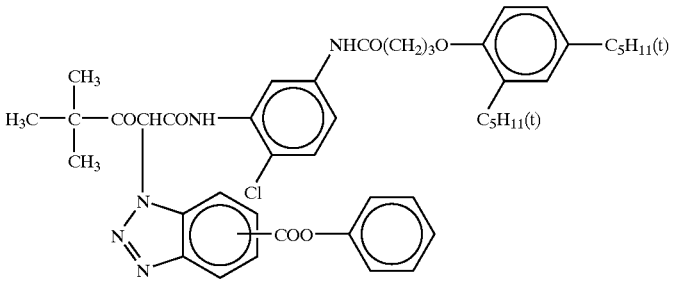

-continued
Cpd-1
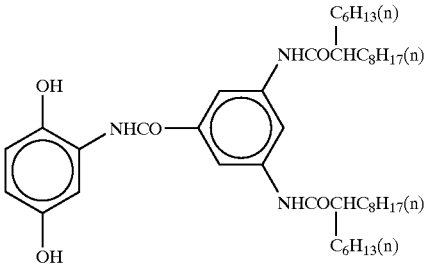
Cpd-2
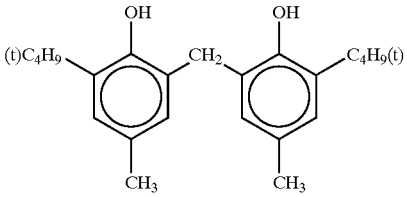
Cpd-3
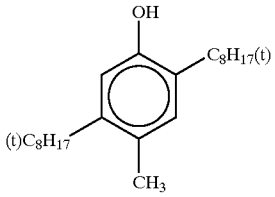
Cpd-4
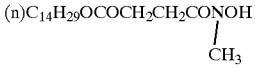
Cpd-5
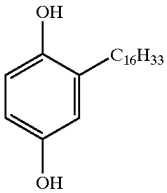
Cpd-6
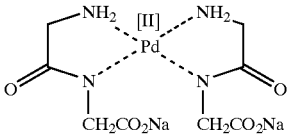
UV-1
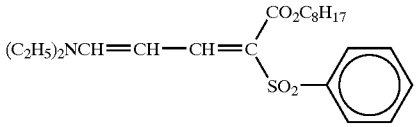
UV-2
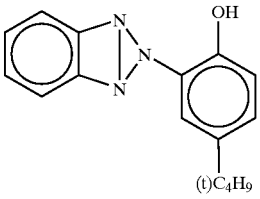
UV-3
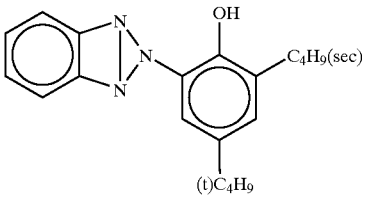
UV-4
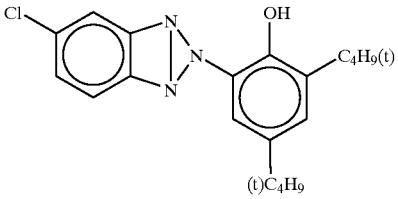
B-1
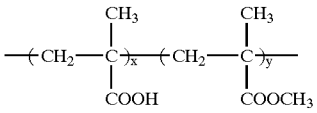
x/y = 10/90 (weight ratio)
av. mol. wt.: about 35,000
B-2
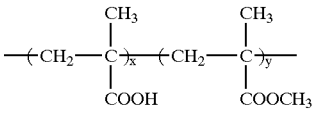
x/y = 40/60 (weight ratio)
av. mol. wt.: about 20,000
B-3
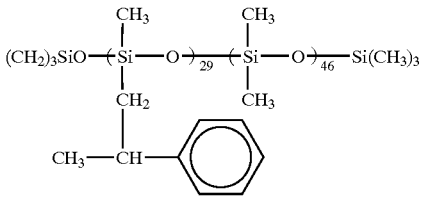
(molar ratio)
av. mol. wt.: about 8,000
H-1
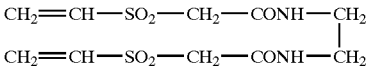
HBS-1
Tricresyl Phosphate
HBS-2
Di-n-butyl Phthalate -continued
HBS-3
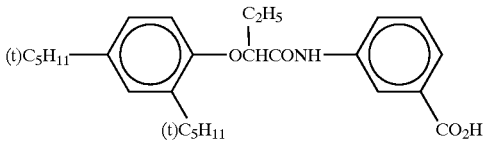
HBS-4
Tri(2-ethylhexyl) Phosphate
HBS-5
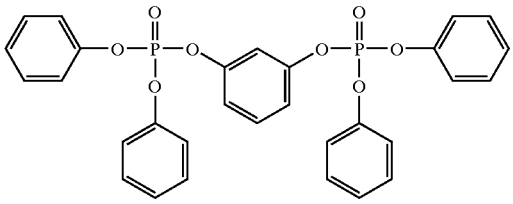
S-1
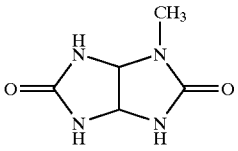
F-1
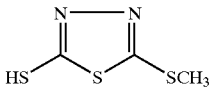
F-2
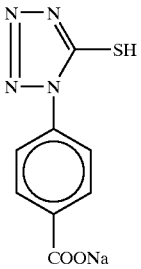
F-3
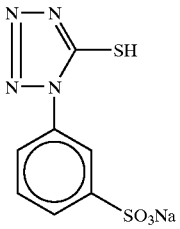
F-4
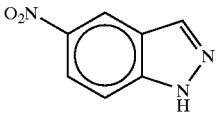
F-5
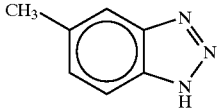
F-6
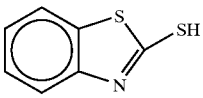
F-7
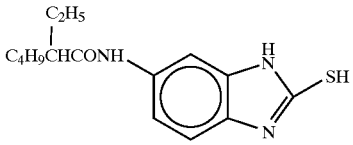
F-8
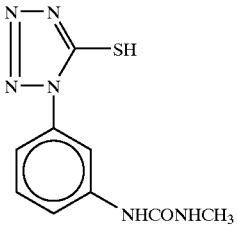
F-9
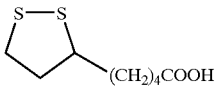
F-10
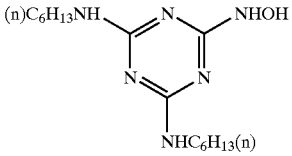
F-11
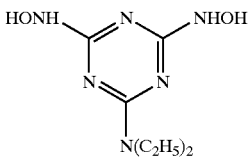
F-12
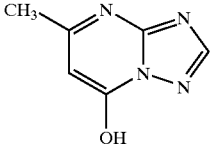

-continued

F-13

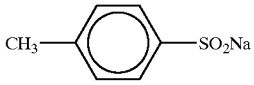

F-14

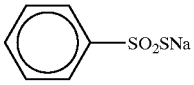

F-15

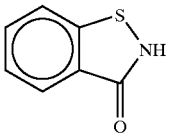

F-16

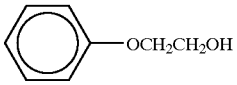

F-17

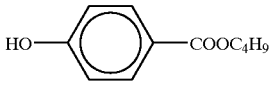

W-1

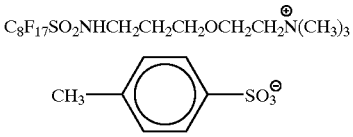

W-2

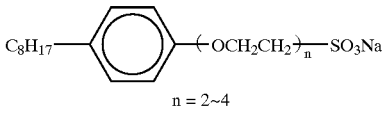

W-3

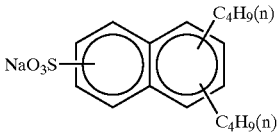

W-4

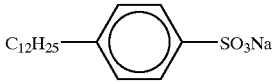

W-5

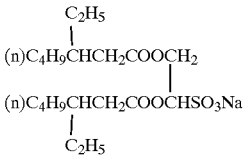

W-6

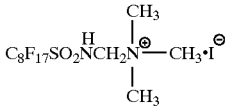

B-4

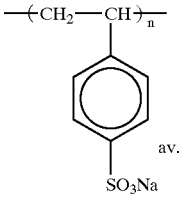

av. mol. wt.: about 750,000

B-5

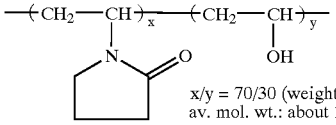

x/y = 70/30 (weight ratio)
av. mol. wt.: about 17,000

B-6

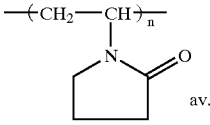

av. mol. wt.: about 10,000

ExF-1

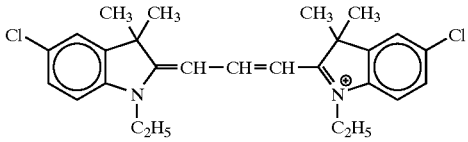

ExF-2

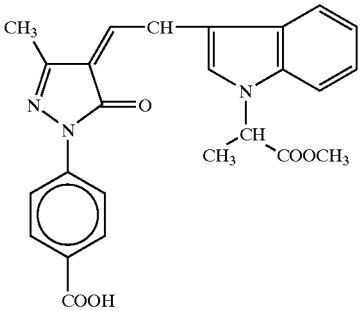

2. Method for Testing Photographic Properties

The above-mentioned sample film was subjected to sensitometry exposure through a standard light source C and a neutral color continuous light wedge (density gradient: 0.4 ΔD/cm, density range: 0.02 to 4.8) according to a method described in International Standards ISO 5800 (a method for measuring sensitivity of a color negative film). This exposed sample was used in the following development processing to determine the photographic properties (sensitivity, gradation and fogging).

3. Development Processing

Development processing was carried out according to the following color negative film processor and processing specification. As the processor, there was used an experimental processor to which an FP-363SC automatic processor manufactured by Fuji Photo Film Co. Ltd. was converted in the processing time. For the above-mentioned sample, long-term running processing was continuously conducted with this processor at a rate of 5 rolls per day for 4 weeks, and then, evaluation was made for the processed sample.

Processing stages and compositions of processing solutions are shown below.

(Processing Stages)

| Stage | Processing Time | Processing Temp. (° C.) | Replenishment Rate* (ml) | Tank Capacity (liter) |
|---|---|---|---|---|
| Color Development | 3 min and 5 sec | 38.0 | 15 | 10.3 |
| Bleaching | 50 sec | 38.0 | 5 | 3.6 |
| Fixing (1) | 50 sec | 38.0 | — | 3.6 |
| Fixing (2) | 50 sec | 38.0 | 7.5 | 3.6 |
| Rinsing (1) | See Table 3 | 38.0 | — | 1.9 |
| Rinsing (2) | See Table 3 | 38.0 | — | 1.9 |
| Rinsing (3) | See Table 3 | 38.0 | See Table 3 | 1.9 |
| Drying | 30 sec | See Table 3 | | |

*The replenishment rate: per 1.1 m of a 35-mm-wide photographic material (corresponding to one roll of 24 Ex.)

A rinsing solution was replenished by a countercurrent system from (3) to (1) via (2), and a fixing solution (1) was connected to a fixing solution (2) by means of a countercurrent pipe from (2) to (1). Further, a tank solution of the rinsing solution (2) was allowed to flow in the fixing solution (2) at a replenishment rate of 15 ml. All of the amount of a developing solution brought in the bleaching stage, the amount of a bleaching solution brought in the fixing stage and the amount of the fixing solution brought in the washing stage were 2.0 ml per 1.1 m of a 35-mm-wide photographic material. In all cases, the crossover time was 6 seconds, and this time was included in the processing time of a preliminary stage.

The compositions of the processing solutions are shown below.

(Color Development Solution)

| | Tank Solution (g) | Replenisher (g) |
|---|---|---|
| Diethylenetriaminepentaacetic Acid | 2.0 | 4.0 |
| Sodium 4,5-Dihydroxybenzene-1,3-di-Sulfonate | 0.4 | 0.5 |
| Disodium-N,N-bis(sulfonatoethyl)-hydroxylamine | 10.0 | 15.0 |
| Sodium Sulfite | 4.0 | 9.0 |
| Potassium Bromide | 1.4 | — |
| 4-Amino-3-methyl-N-ethyl-N-(β-hydroxy-ethyl) aniline sulfate | 4.7 | 11.4 |
| Potassium Carbonate | 39 | 59 |
| Diethylene Glycol | 10.0 | 17.0 |
| Ethylene Urea | 3.0 | 5.5 |
| Hydroxylamine Sulfate | 2.0 | 4.0 |
| Water to make | 1.0 liter | 1.0 liter |
| PH (adjusted with sulfuric acid and KOH) | 10.07 | 10.51 |

(Bleaching Solution)

| | Tank Solution (g) | Replenisher (g) |
|---|---|---|
| Ammonium Ferric 1,3-Diaminopropane-Tetraacetate Monohydrate | 120 | 180 |
| Ammonium Bromide | 50 | 70 |
| Succinic Acid | 30 | 50 |
| Maleic Acid | 40 | 60 |
| Imidazole | 20 | 30 |
| Water to make | 1.0 liter | 1.0 liter |
| pH (adjusted with aqueous ammonia and nitric acid) | 4.6 | 4.0 |

(Fixing Solution)

| | Tank Solution (g) | Replenisher (g) |
|---|---|---|
| Ammonium Thiosulfate (750 g/liter) | 280 ml | 750 ml |
| Aqueous Solution of Ammonium Bi-Sulfite (72%) | 20 | 80 |
| Imidazole | 5 | 45 |
| 1-Mercapto-2-(N,N-dimethylamino-ethyl) tetrazole | 1 | 3 |
| Ethylenediaminetetraaceetic Acid | 8 | 12 |
| Water to make | 1 liter | 1 liter |
| pH (adjusted with aqueous ammonia and nitric acid) | 7.0 | 7.0 |

(Rinsing Solution)

| | Tank Solution (g) | Replenisher (g) |
|---|---|---|
| Sodium p-Toluenesulfinate | | 0.03 |
| Compound of Formula (I) or Compound for Comparison (see Table 3) | 0.4 | |
| Disodium Ethylenediaminetetra-Acetate | | 0.05 |
| 1,2-Benzoisothiazoline-3-one | | 0.10 |
| Water to make | | 1.0 liter |
| pH | | 8.5 |

TABLE 3

| No. | Formula (I) | N/R | Rinsing (1) (sec) | Rinsing (2) (sec) | Rinsing (3) (sec) | Drying (sec) | Drying Temp. (° C.) | Replenishment Rate (ml/m$^2$) | Remark |
|---|---|---|---|---|---|---|---|---|---|
| 1 | Comparison (a) | 0.8 | 30 | 20 | 30 | 90 | 60 | 950 | Comparison |
| 2 | Comparison (a) | 0.8 | 30 | 20 | 30 | 70 | 70 | 950 | Comparison |

TABLE 3-continued

| No. | Formula (I) | N/R | Rinsing (1) (sec) | Rinsing (2) (sec) | Rinsing (3) (sec) | Drying (sec) | Drying Temp. (° C.) | Replenishment Rate ($ml/m^2$) | Remark |
|---|---|---|---|---|---|---|---|---|---|
| 3 | Comparison (a) | 0.8 | 30 | 20 | 30 | 70 | 70 | 850 | Comparison |
| 4 | Comparison (a) | 0.8 | 25 | 25 | 25 | 70 | 70 | 850 | Comparison |
| 5 | Comparison (b) | 1.4 | 25 | 25 | 25 | 70 | 70 | 850 | Comparison |
| 6 | I-1 | 1.3 | 30 | 20 | 30 | 90 | 60 | 950 | Comparison |
| 7 | I-1 | 1.3 | 30 | 20 | 30 | 70 | 70 | 950 | Invention |
| 8 | I-1 | 1.3 | 30 | 20 | 30 | 70 | 70 | 850 | Invention |
| 9 | I-1 | 1.3 | 25 | 25 | 25 | 70 | 70 | 850 | Invention |
| 10 | I-12 | 1.5 | 25 | 25 | 25 | 70 | 70 | 850 | Invention |
| 11 | I-16 | 1.7 | 25 | 25 | 25 | 70 | 70 | 850 | Invention |
| 12 | I-17 | 2.5 | 25 | 25 | 25 | 70 | 70 | 850 | Invention |
| 13 | Comparison (c) | 3.3 | 25 | 25 | 25 | 70 | 70 | 850 | Comparison |

(Note)
Comparison (a): $C_{12}H_{25}$—$(OC_2H_4)_{10}$—OH
Comparison (b): $C_{18}H_{37}$—$(OC_2H_4)_{25}$—OH
Comparison (c): $C_{12}H_{25}$—$(OC_2H_4)_{40}$—OH 4. Test and Results Thereof For the respective samples continuously processed for 4 weeks under the development processing conditions of 3. described above, the presence or absence of roller marks left on surfaces of the samples, curls, undulations on edges of the samples and the presence or absence of processing stains were visually judged, and results thereof are shown in Table 4. In all the items, the sample in which no abnormalities were observed was judged "good", one in which slight abnormalities were observed, but they are within the allowable range was judged "fair", and one in which an unallowable level of abnormalities were observed was judged "poor".

As apparent from Table 4, when the ratio of the number of polyoxyethylene groups to the carbon number of the alkyl group is lower than the range defined in the invention, no abnormalities are observed for the respective evaluation items by drying at a standard replenishment rate (950 ml/m2) at low temperature for a long period of time. However, in test 2 in which the drying temperature is elevated to shorten the time, unsatisfactory results are obtained for respective items, and a reduction in replenishment rate results in further deterioration (test 3). Further, in test 4 in which the rinsing time was shortened, more deterioration was observed, and in test 5 in which comparative compound (a) was changed to comparative compound (b), the same results were also obtained. In contrast, in the examples of the invention (tests 7 to 12) in which the samples were processed using the rinsing solutions containing the compounds of formula (I), and dried at a temperature of 70° C. or more for 70 seconds or less, satisfactory results were obtained for all evaluation items. Further, even though the rinsing solution containing the compound of formula (I) was used, when the sample was dried at low temperature for a long period of time (test 6), stains and roller marks were observed on a surface of the sample. Furthermore, even though the drying conditions within the range defined in the invention, when the ratio of the number of polyoxyethylene groups to the carbon number of the alkyl group is higher than the range defined in the invention, roller marks were also developed (test 13). In the examples of the invention, even when the replenishment rate was decreased, the influence on results was not observed (comparison between tests 7 and 8).

TABLE 4

| No. | Roller Mark | Curl | Undulation on Edge | Stain | Remark |
|---|---|---|---|---|---|
| 1 | Good | Good | Good | Good | Comparison |
| 2 | Poor | Fair | Fair | Fair | Comparison |
| 3 | Poor | Fair | Fair | Poor | Comparison |
| 4 | Poor | Poor | Poor | Poor | Comparison |
| 5 | Poor | Poor | Poor | Poor | Comparison |
| 6 | Fair | Good | Good | Fair | Comparison |
| 7 | Good | Good | Good | Good | Invention |
| 8 | Good | Good | Good | Good | Invention |
| 9 | Good | Good | Good | Good | Invention |
| 10 | Good | Good | Good | Good | Invention |
| 11 | Good | Good | Good | Good | Invention |
| 12 | Good | Good | Good | Good | Invention |
| 13 | Fair | Good | Good | Poor | Comparison |

Example 2

1. Photographic Material Samples

The following commercially available color negative films (both manufactured by Fuji Photo Film Co. Ltd.) were used at a ratio shown below.

Film A: FUJICOLOR SUPERIA400 (24 exposures), production number: V39112

Film B: FUJICOLOR SUPERIA1600 (24 exposures), production number: P01101

These photographic materials were processed at a ratio described below.

Film A:Film B=1:1

2. Exposure and Development Processing

Each photographic material sample was exposed in the same manner as with Example 1, and subjected to the following development processing. The development processing was continuously conducted for 4 weeks, similarly to Example 1, and the processed sample was used for evaluation.

(Processing Stages)

| Stage | Processing Time | Processing Temp. (° C.) | Replenishment Rate* (ml) | Tank Capacity (liter) |
|---|---|---|---|---|
| Color Development | 2 min and 10 sec | 41.0 | 15 | 10.3 |

-continued

| Stage | Processing Time | Processing Temp. (° C.) | Replenishment Rate* (ml) | Tank Capacity (liter) |
|---|---|---|---|---|
| Bleaching | 35 sec | 41.0 | 5 | 3.6 |
| Fixing (1) | 35 sec | 41.0 | — | 3.6 |
| Fixing (2) | 35 sec | 41.0 | 7.5 | 3.6 |
| Rinsing (1) | 20 sec | 41.0 | — | 1.9 |
| Rinsing (2) | 20 sec | 41.0 | — | 1.9 |
| Rinsing (3) | 20 sec | 41.0 | 30 (=780 ml/m$^2$) | 1.9 |
| Drying | 30 sec | 85 | | |

*The replenishment rate in stages other than rinsing: per 1.1 m of a 35-mm-wide photographic material (corresponding to one roll of 24 Ex.)

A rinsing solution was replenished by a countercurrent system from (3) to (1) via (2), and a fixing solution (1) was connected to a fixing solution (2) by means of a countercurrent pipe from (2) to (1). Further, a tank solution of the rinsing solution (2) was allowed to flow in the fixing solution (2) at a replenishment rate of 15 ml. All of the amount of a developing solution brought in the bleaching stage, the amount of a bleaching solution brought in the fixing stage and the amount of the fixing solution brought in the washing stage were 2.0 ml per 1.1 m of a 35-mm-wide photographic material. In all cases, the crossover time was 6 seconds, and this time was included in the processing time of a preliminary stage.

The compositions of the processing solutions are shown below.

(Color Development Solution)

| | Tank Solution (g) | Replenisher (g) |
|---|---|---|
| Diethylenetriaminepentaacetic Acid | 2.0 | 4.0 |
| Sodium 4,5-Dihydroxybenzene-1,3-di-Sulfonate | 0.4 | 0.5 |
| Disodium-N,N-bis(sulfonatoethyl)-hydroxylamine | 10.0 | 15.0 |
| Sodium Sulfite | 4.0 | 9.0 |
| Potassium Bromide | 1.4 | — |
| Diethylene Glycol | 10.0 | 17.0 |
| Ethylene Urea | 3.0 | 5.5 |
| 4-Amino-3-methyl-N-ethyl-N-(β-hydroxy-ethyl) aniline sulfate | 4.7 | 11.4 |
| Compound A (see the following formula) | 2.0 | 3.0 |
| Potassium Carbonate | 39 | 59 |
| Hydroxylamine Sulfate | 2.0 | 4.0 |
| Polyethylene Glycol 2000 | 1.0 | 1.0 |
| Water to make | 1.0 liter | 1.0 liter |
| PH (adjusted with sulfuric acid and KOH) | 10.10 | 11.20 |

(Bleaching Solution)

| | Tank Solution (g) | Replenisher (g) |
|---|---|---|
| Ammonium Ferric 1,3-Diaminopropane-Tetraacetate Monohydrate | 120 | 180 |
| Ammonium Bromide | 50 | 70 |
| Succinic Acid | 25 | 40 |
| Imidazole | 60 | 90 |
| Water to make | 1.0 liter | 1.0 liter |
| pH (adjusted with aqueous ammonia and nitric acid) | 4.6 | 3.8 |

(Fixing Solution)

| | Tank Solution (g) | Replenisher (g) |
|---|---|---|
| Ammonium Thiosulfate (750 g/liter) | 280 ml | 750 ml |
| Aqueous Solution of Ammonium Bi-Sulfite (72%) | 20 | 80 |
| Imidazole | 3 | 30 |
| Ethylenediaminetetraaceetic Acid | 8 | 12 |
| Water to make | 1 liter | 1 liter |
| pH (adjusted with aqueous ammonia and nitric acid) | 7.0 | 7.0 |

(Rinsing Solution)

| | Tank Solution (g) | Replenisher (g) |
|---|---|---|
| Sodium p-Toluenesulfinate | | 0.03 |
| Compound I-12 of Formula (I) | 0.21 | |
| 1,2-Benzoisothiazoline-3-one | | 0.10 |
| Sodium Dichloroisocyanurate | | 0.01 |
| Water to make | | 1.0 liter |
| pH | | 8.5 |

4. Results of Test

For photographic material sample B, the presence or absence of roller marks left on a surface of the sample, curls, undulations on edges of the sample and the presence or absence of processing stains were visually judged in the same manner as with Example 1.

None of roller marks, curls, undulations on edges of the sample and processing stains were observed on the processed sample, resulting in a good finish.

According to a method for processing a silver halide color photographic material, in which a rinsing solution contain- Compound A

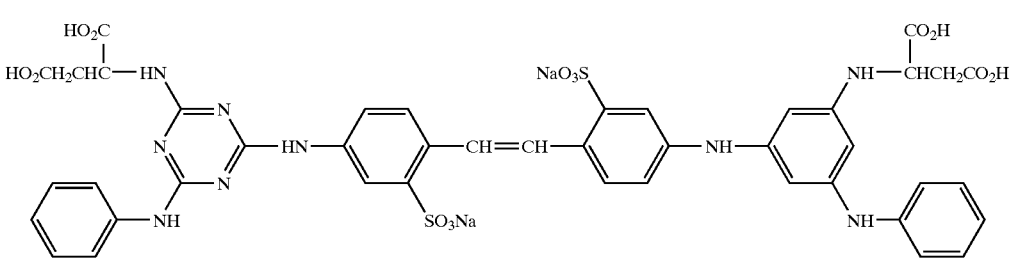

ing a compound represented by $R—(OC_2H_4)_n—OH$ (wherein R represents an alkyl group having from 8 to 12 carbon atoms, n is an integer of from 10 to 30, and n/(the carbon number of R) is from 1.2 to 4.0) and none of an aldehyde compound, an aldehyde releasing compound and a hexamethylenetetramine derivative is used, and drying is carried out at a temperature of 70° C. or more for 70 seconds or less, high-temperature and short-time processing becomes possible without development of functional defects such as roller marks, curls, undulations on edges and processing stains on the processed photographic material, using the rinsing solution free from a substance having a fear about environmental safety, such as formalin or a nonylphenoxy group-containing compound. In particular, rapid short-time processing can be effectively conducted, while securing environmental safety of a color negative film.

The entire disclosure of each and every foreign patent application from which the benefit of foreign priority has been claimed in the present application is incorporated herein by reference, as if fully set forth herein.

What is claimed is:

1. A method for processing a silver halide color negative film comprising subjecting the color negative film to automatic processing with an automatic processor, which comprises the steps of at least color developing, fixing, rinsing and drying after the rinsing, wherein a rinsing solution used in the rinsing step comprises at least one compound represented by the following formula (I) in an amount of from 0.2 g/liter to 0.5 g/liter and is a processing solution comprising none of an aldehyde compound, an aldehyde releasing compound and a hexamethylenetetramine derivative; the rinsing step comprises 3 rinsing baths and in the drying step, the drying temperature is 70° C. to 90° C., and the drying time is 5 seconds to 70 seconds:

$$R—(OC_2H_4)_n—OH \quad (I)$$

wherein R represents an alkyl group having from 8 to 12 carbon atoms, n is an integer of from 10 to 30, and n/(the carbon number of R) is from 1.2 to 4.0, and wherein replenishment of processing solutions used in the color developing, fixing and rinsing steps is carried out.

2. The method according to claim 1, wherein a replenishment amount of the rinsing solution is 850 ml/$m^2$ or less.

3. The method according to claim 1, wherein the rinsing step takes 75 seconds or less.

4. The method according to claim 2, wherein the rinsing step takes 75 seconds or less.

5. The method according to claim 1, wherein the fixing process takes 90 seconds or less.

6. The method according to claim 2, wherein the fixing process takes 90 seconds or less.

7. The method according to claim 3, wherein the fixing process takes 90 seconds or less.

8. The method according to claim 4, wherein the fixing process takes 90 seconds or less.

9. The method according to claim 1, wherein the rinsing step uses a rinsing solution tank and the fixing step uses a fixing tank, and a part of the rinsing solution flows from the rinsing solution tank to the fixing tank.

10. The method according to claim 2, wherein the rinsing step uses a rinsing solution tank and the fixing step uses a fixing tank, and a part of the rinsing solution flows from the rinsing solution tank to the fixing tank.

11. The method according to claim 3, wherein the rinsing step uses a rinsing solution tank and the fixing step uses a fixing tank, and a part of the rinsing solution flows from the rinsing solution tank to the fixing tank.

12. The method according to claim 4, wherein the rinsing step uses a rinsing solution tank and the fixing step uses a fixing tank, and a part of the rinsing solution flows from the rinsing solution tank to the fixing tank.

13. The method according to claim 1, wherein the rinsing solution comprises dichloroisocyanuric acid in an amount of 0.005 g/liter to 0.1 g/liter.

14. The method according to claim 2, wherein the rinsing solution comprises dichloroisocyanuric acid in an amount of 0.005 g/liter to 0.1 g/liter.

15. The method according to claim 3, wherein the rinsing solution comprises dichloroisocyanuric acid in an amount of 0.005 g/liter to 0.1 g/liter.

16. The method according to claim 4, wherein the rinsing solution comprises dichloroisocyanuric acid in an amount of 0.005 g/liter to 0.1 g/liter.

17. The method according to claim 1, wherein the compound represented by the formula (I) is a compound represented by one of the following formulae (I-1), (I-6), (I-12) and (I-16):

$$(n)C_8H_{17}—(OC_2H_4)_{10}—OH \quad (I\text{-}1)$$

$$(n)C_9H_{19}—(OC_2H_4)_{12}—OH \quad (I\text{-}6)$$

$$(n)C_{10}H_{21}—(OC_2H_4)_{15}—OH \quad (I\text{-}12)$$

$$C_{12}H_{25}—(OC_2H_4)_{20}—OH \quad (I\text{-}16).$$

18. The method according to claim 1, wherein the rinsing solution has a temperature of from 41° C. to 45° C.

* * * * *